US010213820B2

(12) United States Patent
Higashi

(10) Patent No.: US 10,213,820 B2
(45) Date of Patent: Feb. 26, 2019

(54) PRESS MOLDING METHOD

(71) Applicant: SHIROKI CORPORATION, Fujisawa-shi (JP)

(72) Inventor: Junichi Higashi, Fujisawa (JP)

(73) Assignee: SHIROKI CORPORATION, Fujisawa-Shi (JP)

( * ) Notice: Subject to any disclaimer, the term of this patent is extended or adjusted under 35 U.S.C. 154(b) by 404 days.

(21) Appl. No.: 14/918,125

(22) Filed: Oct. 20, 2015

(65) Prior Publication Data

US 2016/0129492 A1 May 12, 2016

(30) Foreign Application Priority Data

Nov. 7, 2014 (JP) ..... 2014-226764

(51) Int. Cl.
*B21D 28/16* (2006.01)
*B21D 35/00* (2006.01)

(52) U.S. Cl.
CPC ..... *B21D 28/16* (2013.01); *B21D 35/001* (2013.01)

(58) Field of Classification Search
CPC ..... B21D 22/06; B21D 28/14; B21D 28/16; B21D 28/18; B21D 28/32; B21D 35/001; B21D 37/10; B21D 28/26; B21D 28/34; B21D 28/343; B21J 9/02; B21J 9/022
See application file for complete search history.

(56) References Cited

U.S. PATENT DOCUMENTS

2014/0283695 A1* 9/2014 Futamura ..... B30B 1/186 100/35
2016/0008864 A1* 1/2016 Itaoka ..... B21D 28/24 72/343

FOREIGN PATENT DOCUMENTS

JP 2004-049771 A 2/2004
JP 2004-050212 A 2/2004
JP 2010-036226 A 2/2010
JP 2013-000229 A 1/2013

OTHER PUBLICATIONS

Office Action (without translation) dated Jul. 31, 2018 for the corresponding Japanese Patent Application No. 2014-226764.

* cited by examiner

*Primary Examiner* — Debra M Sullivan
(74) *Attorney, Agent, or Firm* — Polsinelli PC

(57) ABSTRACT

A press molding method of this disclosure includes: disposing a plurality of inner peripheral molding dies inside an outer shape cutting molding die having an annular cross section, the outer shape cutting molding die being configured to press-mold an identical outer shape member from a base material formed of a metal plate, the identical outer shape member having an outer shape identical to a final-shaped member, the inner peripheral molding dies being configured to press-mold all through-holes and all unevenness disposed on the final-shaped member to the base material or the identical outer shape member; and shifting all timings of press moldings to the base material and the identical outer shape member with the outer shape cutting molding die and the plurality of inner peripheral molding dies to one another.

7 Claims, 22 Drawing Sheets

PRESS MOLDING METHOD

CROSS-REFERENCE TO RELATED APPLICATION

This application claims priority from Japanese Patent Application No. 2014-226764 filed with the Japan Patent Office on Nov. 7, 2014, the entire contents of which are hereby incorporated by reference.

BACKGROUND

1. Technical Field

This disclosure relates to a press molding machine for a disk-shaped member and a press molding method.

2. Related Art

JP-A-2013-000229 discloses the reclining seat belonging to the related art. This seat includes the reclining mechanism, which is disposed between the seat cushion side frame and the seat back side frame. This reclining mechanism includes the disk-shaped base plate, the disk-shaped ratchet plate, the rotation center shaft, the three lock members, the cam, and the lock spring. The disk-shaped base plate is secured to the seat cushion side frame. The disk-shaped ratchet plate is secured to the seat back side frame and has annular internal teeth on the inner peripheral surface. The rotation center shaft is inserted into the center through-hole (the shaft support hole) of the base plate and the ratchet plate. The lock members are supported by the base plate so as to be relatively movable in the radial direction of the rotation center shaft. The cam rotates in conjunction with the rotation center shaft. The lock spring rotatably biases the cam.

The base plate and the ratchet plate are made of metal. Generally, these plates are manufactured by performing a progressive press on a base material formed of a metal plate using a press molding machine.

For example, to mold the ratchet plate by the progressive press using the press molding machine, a plurality of molding dies are aligned in a conveying direction (a horizontal direction) of the base material (the workpiece) to set the molding dies in the press molding machine. These molding dies are necessary by the number of process operations (presswork). That is, for example, a drilling molding die, a concavo-convex shape forming molding die, an outer shape cutting molding die, an internal teeth forming molding die, and the like are necessary. The drilling molding die drills a center through-hole (a shaft support hole) on the base material. The concavo-convex shape forming molding die molds concavo-convex shapes formed on the front surface and the back surface of the base material. The outer shape cutting molding die cuts out a disk having an outer shape (a circular shape) identical to the ratchet plate from the base material. The internal teeth forming molding die forms internal teeth on the inner peripheral surface of the disk.

The press molding machine includes one driving unit. To this driving unit, mold support unit is coupled so as to be vertically movable. This mold support unit supports the respective molding dies.

When the base material is supplied to the press molding machine where these molding dies are set, the conveying unit, which is disposed in the press molding machine, moves the base material in one direction (the horizontal direction) at predetermined pitches. In each execution of the conveying operation, the respective molding dies simultaneously perform a press molding operation (vertical movement) on different sites of the base material (the plurality of sites separated from one another by the pitches).

Accordingly, when the base material is conveyed by the predetermined number of pitches (the number of pitches identical to a number of the types of molding dies), molding (processing) to the predetermined sites on the base material with the drilling molding die, the concavo-convex shape forming molding die, the outer shape cutting molding die, and the internal teeth forming molding die is all completed. These sites become the completed product of the ratchet plate (the ratchet plate includes the center through-hole, the plurality of concavo-convex portions, and internal teeth. The center through-hole is drilled with the drilling molding die. The concavo-convex portions are formed with the concavo-convex shape forming molding die. The concavo-convex portions are positioned on the outer periphery side of the center through-hole. The internal teeth are disposed on the inner peripheral portion of the disk and are formed with the internal teeth forming molding die. The ratchet plate is a processed product cut out as the disk-shaped member at a site positioned on the outer periphery side of the concavo-convex portion with the outer shape cutting molding die).

Repeating these operations sequentially manufactures (press-molds) a plurality of (a large number of) ratchet plates from the base material.

Setting the various molding dies for base plate molding to the press molding machine allows manufacturing the plurality of base plates from the base material formed of a metal plate by the manner (the progressive press) similar to the manner for the ratchet plate.

SUMMARY

A press molding method of the present disclosure includes: disposing a plurality of inner peripheral molding dies inside an outer shape cutting molding die having an annular cross section, the outer shape cutting molding die being configured to press-mold an identical outer shape member from a base material formed of a metal plate, the identical outer shape member having an outer shape identical to a final-shaped member, the inner peripheral molding dies being configured to press-mold all through-holes and all unevenness disposed on the final-shaped member to the base material or the identical outer shape member; and shifting all timings of press moldings to the base material and the identical outer shape member with the outer shape cutting molding die and the plurality of inner peripheral molding dies to one another.

DETAILED DESCRIPTION

Figure 1:
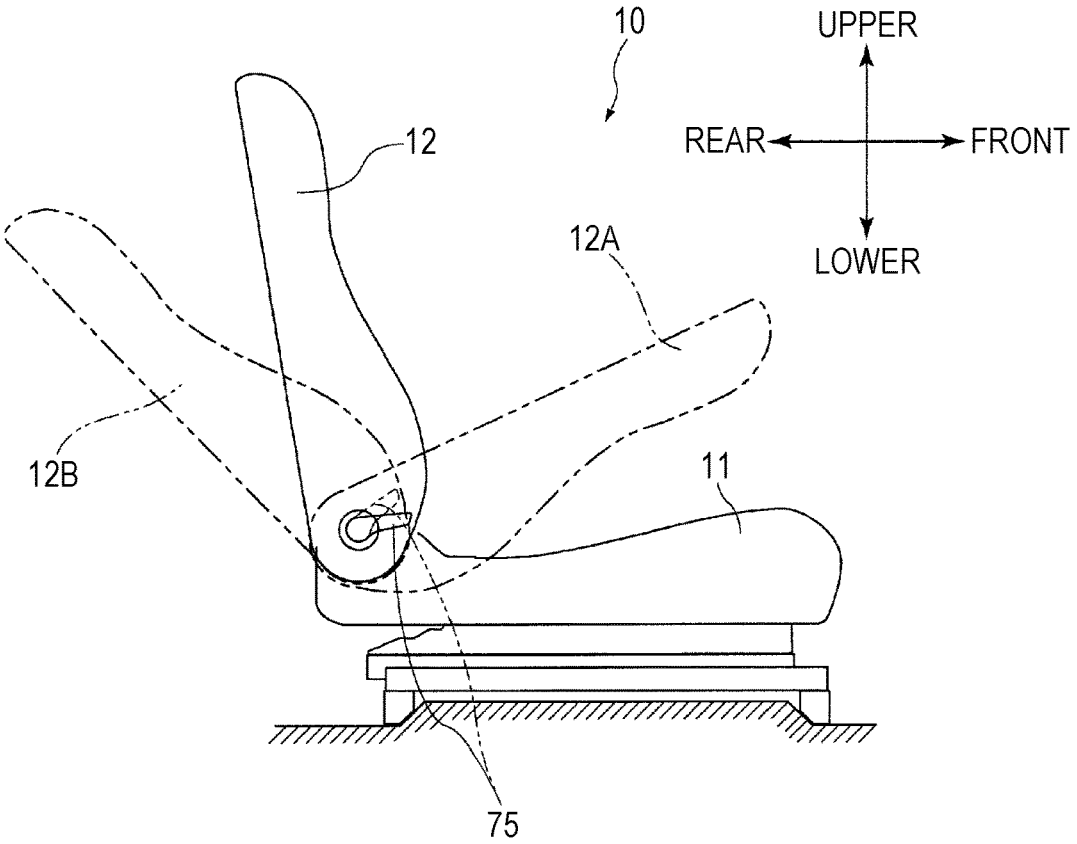
FIG. 1 is a side view of a reclining seat of one embodiment of this disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

When using a press molding machine for progressive press, a plurality of molding dies is aligned in a conveying direction (a horizontal direction) of a base material (workpiece). Therefore, there is no choice but to increase the size of mold support unit (in the conveying direction of the base material).

Further, one driving unit performs mold clamping with all molding dies (simultaneously). This necessitates the large-sized driving unit.

Therefore, the entire press molding machine becomes a large size.

Further, the one driving unit simultaneously performs the mold clamping and mold opening on the respective molding dies.

However, since the shapes of the respective molding dies differ, a magnitude of pressure given from the respective molding dies to the base material (the workpiece) during the mold clamping and a magnitude of reactive force from the base material (the workpiece) to the respective molding dies differ depending on the molding dies. Therefore, the force given to the mold support unit during the mold clamping differs depending on the respective sites of the mold support unit (the respective sites supporting the respective molding dies).

Therefore, during the mold clamping, the mold support unit is inclined in the horizontal direction. As a result, the mold clamping force of the respective molding dies is less likely to be a desired magnitude.

The object of the disclosure is to provide a press molding method of a disk-shaped member for a reclining mechanism by which a press molding machine can be downsized compared with a progressive press type press molding machine and which additionally can easily design mold clamping force of respective molding dies into a desired magnitude. The object of the disclosure is also to provide the press molding machine for the disk-shaped member for the reclining mechanism.

A press molding method of the disclosure includes: disposing a plurality of inner peripheral molding dies inside an outer shape cutting molding die having an annular cross section, the outer shape cutting molding die being configured to press-mold an identical outer shape member from a base material formed of a metal plate, the identical outer shape member having an outer shape identical to a final-shaped member, the inner peripheral molding dies being configured to press-mold all through-holes and all unevenness disposed on the final-shaped member to the base material or the identical outer shape member; and shifting all timings of press moldings to the base material and the identical outer shape member with the outer shape cutting molding die and the plurality of inner peripheral molding dies to one another.

In the press molding method of the disclosure, the final-shaped member may be a disk-shaped member, and the identical outer shape member may be a disk. The disk-shaped member may be at least one member of a base plate and a ratchet plate disposed in a reclining mechanism, the base plate may be secured to one of a seat cushion and a seat back and the ratchet plate may be secured to the other of the seat cushion and the seat back, and the ratchet plate may be rotatable relative to the base plate while the ratchet plate is opposed to the base plate.

The reclining mechanism may include a lock member on a surface of the base plate opposed to the ratchet plate, the lock member being supported to be relatively movable in a radial direction of the base plate, the lock member having external teeth on an outer peripheral portion. The ratchet plate may have internal teeth on an inner peripheral surface, the internal teeth being engageable with the external teeth of the lock member, the internal teeth being one of the unevenness. Timing of press molding of the internal teeth with the inner peripheral molding dies for molding the internal teeth of the ratchet plate may be later than timing of press molding with the other inner peripheral molding dies and the outer shape cutting molding die.

The press molding method of the disclosure further includes using a press molding machine including the outer shape cutting molding die and the plurality of inner peripheral molding dies. A center axis of a movable member of the press molding machine and a center axis of the outer shape cutting molding die may have an identical axis.

Rotation regulating portions may be disposed at opposed portions of the outer shape cutting molding die and the inner peripheral molding dies or/and opposed portions of two of the inner peripheral molding dies adjacent to one another in a radial direction of the outer shape cutting molding die, the inner peripheral molding dies being opposed from an inside of the outer shape cutting molding die, the rotation regulating portions being configured to restrict a relative rotation of opposed molding dies in a circumferential direction.

The rotation regulating portion may have planes formed on opposed surfaces of the respective opposed molding dies.

The press molding machine for the disk-shaped member for the reclining mechanism according to the disclosure is configured to press-mold the disk-shaped member. The disk-shaped member is at least one of members among the base plate and the ratchet plate disposed in the reclining mechanism. The base plate is secured to one of a seat cushion and a seat back while the ratchet plate is secured to the other. The ratchet plate is rotatable relative to this base plate while the ratchet plate is opposed to this base plate. The press molding machine includes the outer shape cutting molding die and the plurality of inner peripheral molding dies. The outer shape cutting molding die has a circular shape in cross-section. The outer shape cutting molding die is configured to press-mold a disk from a base material formed of a metal plate. The disk has an outer shape identical to the disk-shaped member. The plurality of inner peripheral molding dies is disposed inside the outer shape cutting molding die. The inner peripheral molding dies are configured to press-mold all through-holes and all unevenness disposed on the disk-shaped member to the base material or the disk. The press molding machine shifts all timings of press moldings to the base material and the disk with the outer shape cutting molding die and the plurality of inner peripheral molding dies to one another.

The reclining mechanism includes the lock member on the surface of the base plate opposed to the ratchet plate. The lock member is supported so as to be relatively movable in the radial direction of this base plate. The lock member has external teeth on the outer peripheral portion thereof. The ratchet plate has internal teeth on the inner peripheral surface. The internal teeth are engageable with the external teeth of the lock member. The internal teeth are one of the unevenness. Timing of press molding of the internal teeth with the inner peripheral molding dies may be later than timing of press molding with the other inner peripheral molding dies and the outer shape cutting molding die. The molding of the internal teeth is configured to mold the internal teeth of the ratchet plate.

According to the press molding method or the press molding machine of this disclosure, the disk (the identical outer shape member) having the outer shape identical to the disk-shaped member (the final-shaped member, namely, the base plate or the ratchet plate) is press-molded from the base material formed of the metal plate. The plurality of inner peripheral molding dies is disposed inside the outer shape cutting molding die. The outer shape cutting molding die has the circular shape in cross-section (the annular cross-section) for this press molding. The inner peripheral molding dies are configured to press-mold all the through-holes and all the unevenness disposed on the disk-shaped member (the final-shaped member). This allows downsizing the space for disposing (installing) the molding dies in the press molding machine more than the space for the progressive type press molding machine.

Furthermore, all timings of the press moldings with the outer shape cutting molding die and the plurality of inner peripheral molding dies are shifted to one another. This allows mold clamping on the molding dies by driving unit of small output (driving force). This allows using small-sized driving unit.

Therefore, the press molding machine of this disclosure can be downsized more than the progressive type press molding machine.

Furthermore, the timings of press work with the outer shape cutting molding die and the plurality of inner peripheral molding dies are all shifted to one another. Therefore, to perform the mold clamping on one molding die, the mold clamping force from the other molding dies does not affect the mold clamping force of this molding die.

Accordingly, the mold clamping force from the respective molding dies is easily controlled to a desired magnitude.

According to another configuration of the press molding machine of this disclosure, among the press work of the ratchet plate, work to mold the internal teeth is performed last. That is, after molding the internal teeth, another press work is not performed on the ratchet plate. This retains the shape of the molded internal teeth as it is. Therefore, when press-molding the ratchet plate, the final shape of the internal teeth is likely to be the desired shape.

According to another configuration of the press molding machine of this disclosure, the center axis of the movable member of the press molding machine and the center axis of the outer shape cutting molding die have the axis identical to one another. This allows transmission of a load from the press molding machine to the outer shape cutting molding die without reduction.

According to another configuration of the press molding machine of this disclosure, the outer shape cutting molding die and the respective inner peripheral molding dies are less likely to be inclined with respect to a normal mold clamping direction. This allows accurate press molding of the disk-shaped member.

According to another configuration of the press molding machine of this disclosure, the rotation regulating portions can be achieved with a simple configuration.

The following describes one embodiment of this disclosure with reference to the accompanying drawings. The directions in the following description are based on the arrow directions in the drawings. In the following description, the "inner peripheral side" means the "center side of a base plate 27" and the "outer periphery side" means "the opposite side from that center side of the base plate 27."

A reclining seat 10 (a vehicle seat), which is illustrated in FIG. 1, constitutes a seat on the right side (the driver's seat). This vehicle seat includes a seat cushion 11 and a rotatable seat back 12. The seat cushion 11 is supported to the floor face inside the vehicle via a seat rail. The seat back 12 is disposed on the back portion of the seat cushion 11. At the inside of the reclining seat 10, a rotation biasing spring (rotation biasing unit) is disposed. The rotation biasing spring rotatably biases the seat back 12 forward toward the seat cushion 11.

At the inside of the seat cushion 11, a right and left pair of metallic seat cushion side frames are securely disposed.

These seat cushion side frames are plate-shaped members extending in the front-rear direction. The rear portion includes a metallic rear frame 13 (see FIG. 2) projecting upward from the rear portion of the seat cushion 11. On the rear frame 13, a cushion side coupling hole 14 is formed as a through-hole. The cushion side coupling hole 14 includes three fitting holes 15 having an approximately rectangular shape. The fitting holes 15 are circumferentially disposed at intervals of 120° on the peripheral edge portion of the circular hole.

On the inside of the seat back 12, a right and left pair of metallic seat back side frames 16 (see the imaginary line in FIG. 2) are secured. The seat back side frame 16 is a plate-shaped member extending in the longitudinal direction of the seat back 12. At the lower portion (the rear portion when the seat back 12 is inclined forward) of the seat back side frame 16, a seat back side coupling hole 17 is formed as a through-hole. The seat back side coupling hole 17 is constituted of approximately square-shaped hole and approximately rectangular fitting holes 18, which are four in total. The rectangular-shaped fitting holes 18 are formed at the respective peripheral edge portions (the four sides) of the approximately square-shaped hole.

The right and left rear frames 13 enter into the internal space of the seat back 12. Between the right and left rear frames 13, the right and left seat back side frames 16 are positioned. The respective right and left seat back side frames 16 and the right and left rear frames 13 are opposed in the lateral direction (the vehicle-width direction). The rear frame 13 and the seat back side frame 16 on the left side (the vehicle inner side) of the reclining seat 10 are rotatably coupled via a rotation coupling shaft (not illustrated). Meanwhile, between the rear frame 13 and the seat back side frame 16 on the right side (the vehicle outer side), a reclining mechanism 25 is disposed. The reclining mechanism 25 couples the rear frame 13 and the seat back side frame 16 so as to be rotatable around the axis in the lateral direction.

The seat back 12 (the seat back side frame 16) is rotatable to the seat cushion 11 (the rear frame 13) around these rotation coupling shaft and reclining mechanism 25. Specifically, the seat back 12 (the seat back side frame 16) is rotatable between a forward leaning position, which is indicated by reference numeral 12A in FIG. 1, and a backward leaning position, which is indicated by reference numeral 12B in FIG. 1.

The following describes a detailed structure of the reclining mechanism 25.

The reclining mechanism 25 includes the base plate 27, lock members 36 (poles), a rotation cam 47, a rotation center shaft 51, a ratchet plate 57, a press ring 64, and a lock spring 68 as main components.

The base plate 27, which is a metallic disk-shaped member, is a press-molded product. At the peripheral edge portion of the left side surface of the base plate 27, a circular, large-diameter annular flange 28 is disposed to protrude. An accommodation space is formed at the inside of the large-diameter annular flange 28. At the center of the base plate 27, a shaft support hole 29, which has a circular shape in cross-section, is formed as a through-hole. At the left side surface of the base plate 27, three groove forming projections 30 (see FIGS. 3 to 5), which have approximately fan shape, are disposed to protrude. The groove forming projections 30 are circumferentially disposed at intervals of 120° around the shaft support hole 29. As illustrated in the drawing, between the outer peripheral surfaces of the respective groove forming projections 30 and the large-diameter annular flange 28, arc-shaped clearances are formed. Both side surfaces of the respective groove forming projections 30 constitute guide planes 30*a*, which are formed into a plane. Between the guide planes 30*a* (the opposed surfaces), which are parallel to one another, of the adjacent groove forming projections 30, a guide groove 31 is formed. Further, welding projections 33, which are three in total, are disposed to protrude on the right side surface of the base plate 27 (see FIG. 2). The welding projections 33 are positioned on the back sides of the respective guide grooves 31. Projection-corresponding concave portions 32 are disposed on the lower faces (the left side surfaces) of the respective guide grooves 31. The projection-corresponding concave portions 32 are concaved on the back sides of the respective welding projections 33 (see FIGS. 19 and 20). The welding projections 33 each have an approximately rectangular shape. Further, a pair of locking projections 35 are disposed to protrude rightward on the right side surface of the base plate 27 (see FIGS. 2 and 6). The locking projections 35 are positioned near the welding projection 33 positioned at the front side.

At the respective guide grooves 31 on the base plate 27, the lock members 36 are disposed.

The three lock members 36 are press-molded products formed of a metal plate. The thickness of the lock member 36 is approximately identical to the depth of the guide groove 31. A cam groove 38 is formed at the lock member 36. Furthermore, external teeth 40 are formed on the arc-shaped outer peripheral surface of the lock member 36. The right side surface of the lock member 36 forms a plane. Further, engaging projections 40*a*, which include projections having approximately rectangular shape in cross-section, are disposed to protrude on the left side surfaces of the lock members 36.

The rotation cam 47 is a press-molded product formed of a metal plate. The thickness of the rotation cam 47 is approximately identical to the depth of the guide groove 31. On the center of the rotation cam 47, a non-circular center hole 48 is formed as a through-hole. The non-circular center hole 48 has a non-circular shape, which is obtained by linearly cutting off the opposed two sites of the circumference. Three cam projections 49 are disposed to protrude on the outer peripheral portion of the rotation cam 47. The cam projections 49 are circumferentially disposed at intervals of 120°. As illustrated in the drawing, the rotation cam 47 is disposed at the center of the accommodation space of the base plate 27. On the left side surface of the rotation cam 47, three rotation stop projections (not illustrated) are disposed to protrude leftward. The rotation stop projections are circumferentially disposed at equiangular intervals. The three rotation stop projections have a columnar shape with identical specifications. Furthermore, three lock member pressing portions 47*b* are circumferentially formed on the outer peripheral surface of the rotation cam 47 at equiangular intervals.

The metallic rotation center shaft 51 includes a cam coupling shaft 52 and an annular flange 54.

The cam coupling shaft 52 is a tubular member having a non-circular cross section. Both ends of the cam coupling shaft 52 are open. The cross-sectional shape of the cam coupling shaft 52 is similar to the non-circular center hole 48 and has a diameter slightly smaller than the non-circular center hole 48. The cross-sectional shape of a coupling hole 53, which is formed inside the cam coupling shaft 52, is also similar to the non-circular center hole 48.

The annular flange 54 is disposed to protrude on and integrally with the left end portion of the cam coupling shaft 52. The annular flange 54 is perpendicular to the axis line of the cam coupling shaft 52 and has a flat plate shape.

Figure 2:
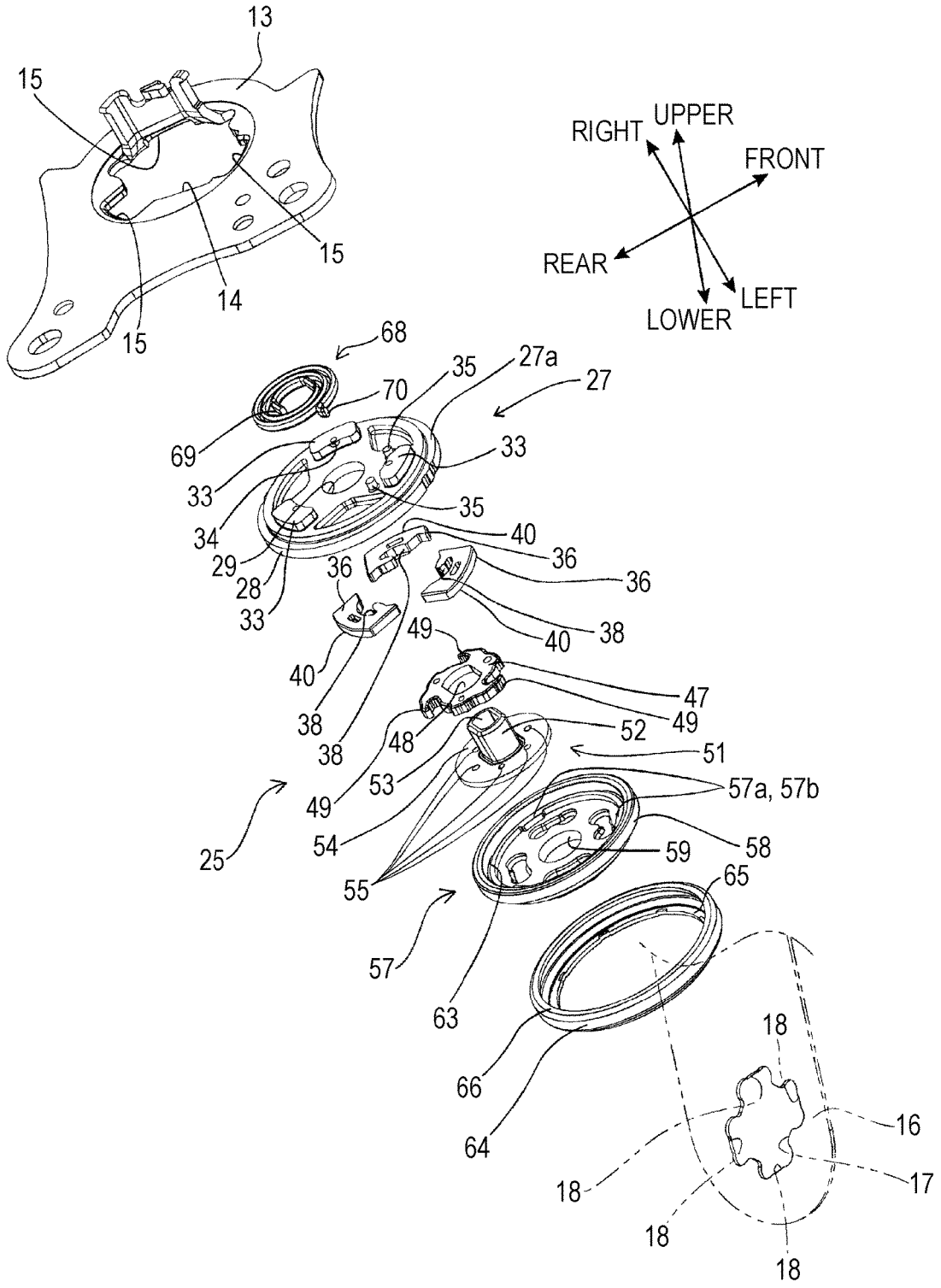
FIG. 2 is an exploded perspective view of a reclining mechanism.

Further, six rotation stop punches 55 (only the five of them are illustrated in FIG. 2) are formed on the annular flange 54. The rotation stop punches 55 are circumferentially disposed at equiangular intervals.

The rotation center shaft 51 is secured to the rotation cam 47. Here, the lock members 36 and the rotation cam 47 are disposed at a minute clearance between the annular flange 54 and the base plate 27. The three rotation stop projections are each fitted one by one to the respective three rotation stop punches 55. The cam coupling shaft 52 freely fits to the non-circular center hole 48. The distal end portion (the right end portion) of the cam coupling shaft 52 projects to the right side of the base plate 27. Fitting the three rotation stop projections to the respective rotation stop punches 55 substantially eliminates a backlash between the rotation stop punch 55 and each rotation stop projection. This integrates the rotation cam 47 and the rotation center shaft 51 (restricts the relative rotation between the rotation cam 47 and the rotation center shaft 51). Accordingly, the rotation of the rotation center shaft 51 around the axis line of the rotation center shaft 51 with respect to the base plate 27 (the shaft support hole 29) rotates the rotation cam 47 in conjunction with the rotation center shaft 51.

The ratchet plate 57, which is the metallic disk-shaped member, is a press-molded product. A circular, small-diameter annular flange 58 is disposed to protrude on the peripheral edge portion on the right side surface of the ratchet plate 57. The small-diameter annular flange 58 internally forms an accommodation space. A shaft support hole 59, which has the circular shape in cross-section, is formed on the center of the ratchet plate 57 as a through-hole. Welding projections 60, which are four in total, are disposed to protrude on the left side surface of the ratchet plate 57 (see FIGS. 10 to 12). The welding projections 60 are circumferentially disposed around the shaft support hole 59 at intervals of 90°. An annular stepped portion 62 is formed on the outer peripheral edge portion of the left side surface of the ratchet plate 57 (see FIG. 12). The annular stepped portion 62 is positioned on the back side of the small-diameter annular flange 58. On the inner peripheral surface of the small-diameter annular flange 58, internal teeth 63 are formed. Furthermore, at the part positioned at the left side by one level from the internal teeth 63, which is on the inner peripheral surface of the small-diameter annular flange 58, three topping projections 57*a* are disposed to protrude toward the inner peripheral side (see FIGS. 2 to 5). The topping projections 57*a* are circumferentially disposed at equiangular intervals. As illustrated in the drawing, the topping projections 57*a* circumferentially extend around the shaft support hole 59. The inner peripheral surfaces of the respective topping projections 57*a* form an unlock retaining surface 57*b*. The unlock retaining surface 57*b* is formed of an arc surface setting the center point of the ratchet plate 57 as the center. The ratchet plate 57 covers the left side surface of the base plate 27. The small-diameter annular flange 58 is inserted into a clearance between the inner peripheral surface of the large-diameter annular flange 28 and the outer peripheral surface of the groove forming projection 30. Here, the left side surface of the annular flange 54 faces the lower portion face (the right side surface) of the accommodation space of the ratchet plate 57 while forming a minute clearance. This restrains an inclination of the rotation center shaft 51 with respect to the axial direction thereof. This also restrains a slip of the lock members 36 and the rotation cam 47 in the axial direction of the rotation center shaft 51 in the accommodation space between the base plate 27 and the ratchet plate 57.

The outer diameter of the press ring 64, which is a metallic ring-shaped member, has a diameter slightly larger than the base plate 27. On the left end portion of the press ring 64, an annular opposed portion 65 is formed projecting toward the inner peripheral side (see FIG. 2). The press ring 64 covers the peripheral edge portions of the base plate 27 and the ratchet plate 57. The annular opposed portion 65 is positioned on the left side of the annular stepped portion 62 of the ratchet plate 57 and is opposed to the press ring 64. An annular crimped portion 66 is formed on the right end portion of the press ring 64. An annular concave portion 27*a* (see FIGS. 2 and 20) is formed at the outer peripheral portion on the right side surface of the base plate 27. Crimping the annular crimped portion 66 with the annular concave portion 27*a* secures the press ring 64 to the base plate 27. Integrating (securing) the base plate 27 with (to) the press ring 64 positions the ratchet plate 57 between the base plate 27 and the press ring 64. This avoids the ratchet plate 57 to be dropped from the base plate 27 and the press ring 64. This makes the ratchet plate 57 to be relatively rotatable with respect to the base plate 27 and the press ring 64 around the rotation center shaft 51.

Further, the lock spring 68 is disposed on the right side surface of the base plate 27. The lock spring 68 is formed by spirally winding a strip-shaped metal wire rod. The end portion on the inner peripheral side of the lock spring 68 is linearly bent to constitute a first locking portion 69. The end portion on the outer periphery side of the lock spring 68 extends in a direction approximately parallel to the radial direction of the lock spring 68 to constitute a second locking portion 70 (see FIG. 6).

Figure 6:
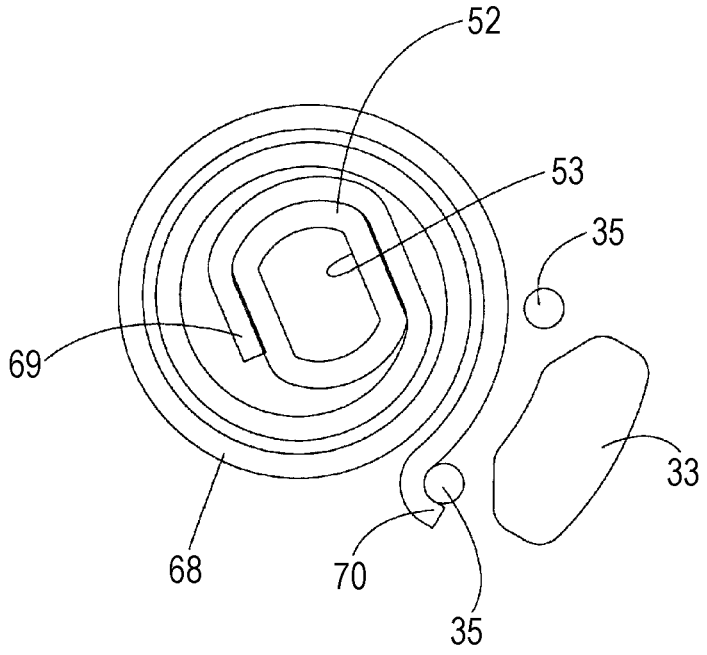
FIG. 6 is a side view illustrating a part of enlarged base plate and enlarged lock spring.

The lock spring 68 is disposed on the peripheral area of the right edge portion of the cam coupling shaft 52, which projects from the base plate 27. As illustrated in FIG. 6, the first locking portion 69 is locked to a planar portion forming a part of the circumferential surface of the cam coupling shaft 52. The second locking portion 70 is locked to one locking projection 35.

Figure 3:
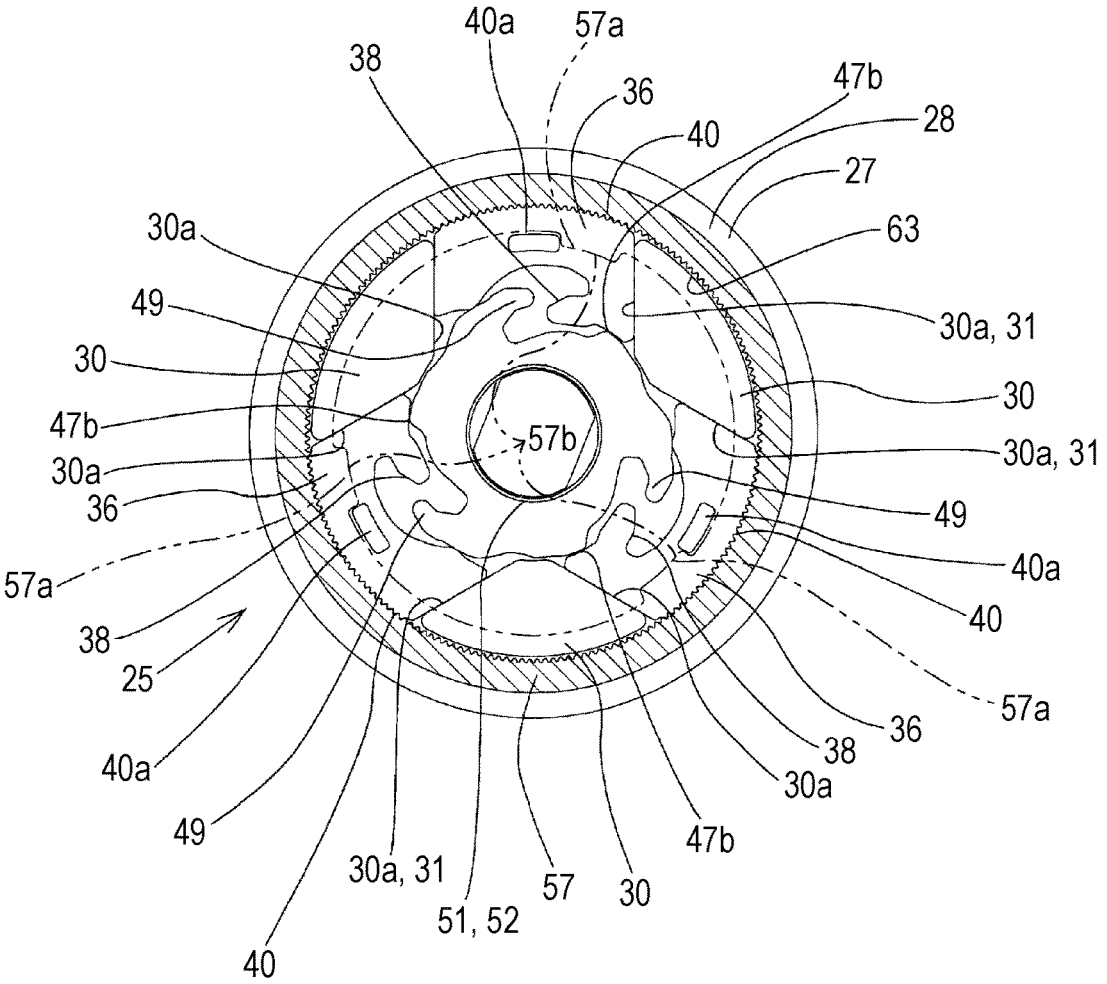
FIG. 3 is a cross-sectional view of the reclining mechanism illustrated omitting a seat cushion side frame, a press ring, a rotation stop projection, and an annular flange.
Figure 4:
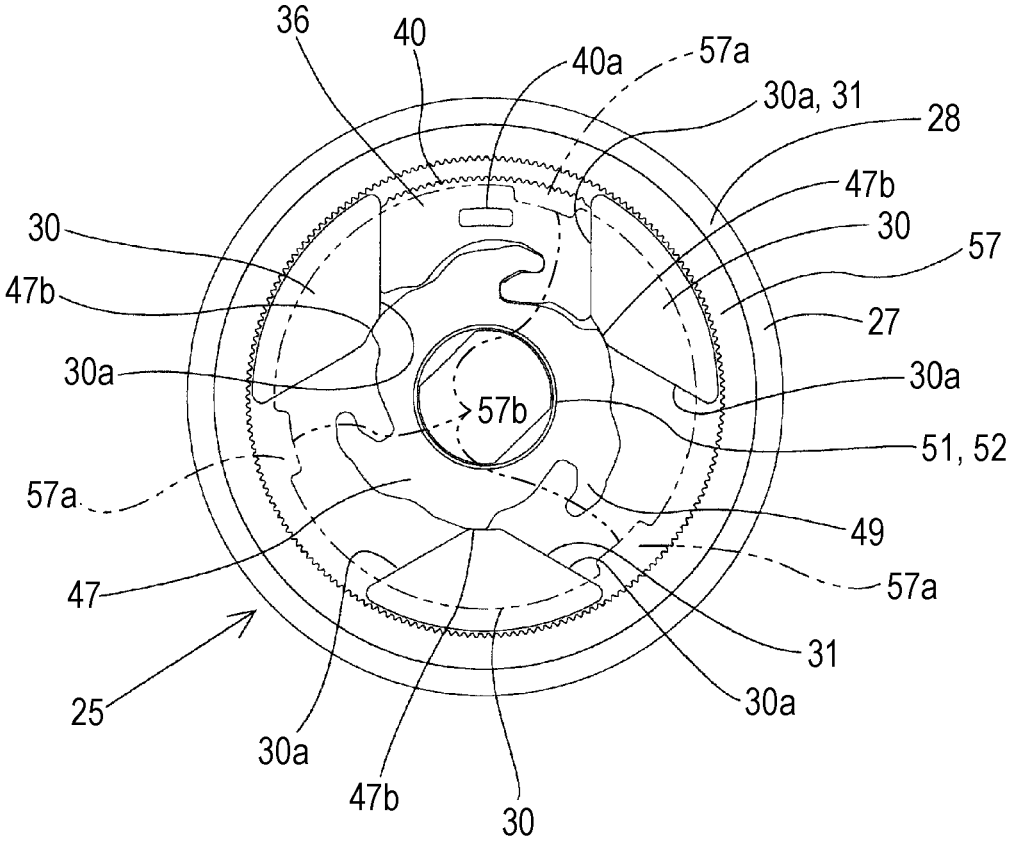
FIG. 4 is a cross-sectional view equivalent to FIG. 3 that illustrates the reclining mechanism in an unlock state further omitting two lock members.
Figure 5:
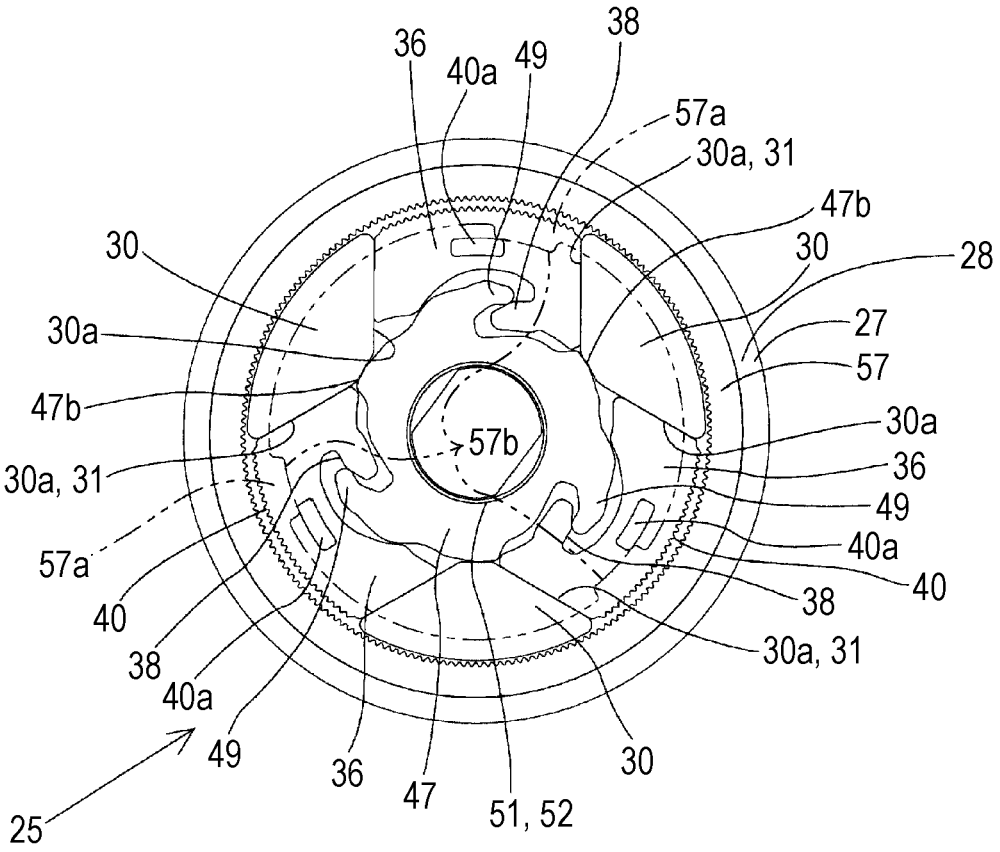
FIG. 5 is a cross-sectional view equivalent to FIG. 3 where the reclining mechanism is in a topping state (an unlock retained state)

Thus, the lock spring 68 is mounted to the base plate 27 and the rotation center shaft 51 (the cam coupling shaft 52). Then, the lock spring 68 slightly deforms elastically and generates a biasing force to rotate the rotation center shaft 51 in one direction. This biasing force, as illustrated in FIGS. 3 to 5, is a force to rotate the rotation center shaft 51 in the counterclockwise direction. Therefore, when an external force other than a force from the lock spring 68 is not given to the rotation center shaft 51, the rotation cam 47 is positioned at a lock position illustrated in FIG. 3. Then, the respective lock member pressing portions 47*b* press the corresponding lock members 36 in a lock direction (the outer periphery side). This meshes the external teeth 40 of the respective lock members 36 with the internal teeth 63. This restricts the relative rotation between the base plate 27 and the ratchet plate 57. Further, a part of the engaging projections 40*a* and the respective topping projections 57*a* of the lock members 36 are paired and are positioned on a circumference of which center is identical to the rotation center shaft 51. The outer peripheral surface of the engaging projection 40*a* of the lock member 36 is positioned on the outer periphery side with respect to the unlock retaining surface 57*b* of each topping projection 57*a* (see FIG. 3).

Meanwhile, as illustrated in FIGS. 3 to 5, against the rotary biasing force by the lock spring 68, the rotation center shaft 51 is rotated in the clockwise direction. Then, the rotation cam 47 positioned at the lock position rotates until arriving at the unlock position, which is illustrated in FIG. 4 (since the range of the unlock position provides a sufficient width, the rotation cam 47 illustrated in FIG. 5 is also in the unlock position). Then, the lock member pressing portion 47*b* separates from the corresponding lock member 36 to the inner peripheral side. Furthermore, the cam projections 49 each engage the corresponding cam groove 38 and moves the corresponding lock member 36 to the inside in the radial direction until the lock member 36 arrives at the non-engaging position, which is illustrated in FIG. 4 (since the range of the non-engaging position provides a sufficient width, the lock members 36 illustrated in FIG. 5 are also in the non-engaging position). This releases the engagement between the external teeth 40 of the lock member 36 and the internal teeth 63. This allows the relative rotation between the base plate 27 and the ratchet plate 57. Further, the outer peripheral surface of the engaging projection 40*a* of the lock member 36 is positioned on the inner peripheral side with respect to the unlock retaining surface 57*b* of each topping projection 57*a* (see FIG. 4).

The base plate 27 of the reclining mechanism 25 is mounted to the rear frame 13. Welding projections 33 are fitted to respective fitting holes 15. A part across the outer peripheral edge portion of each fitting hole 15 and the outer peripheral edge portion on the right end surface of each welding projection 33 is welded (not illustrated) from the right side surface side of the rear frame 13. This secures the rear frame 13 with the base plate 27.

Meanwhile, in the ratchet plate 57 of the reclining mechanism 25, the welding projections 60 are fitted to the respective fitting holes 18. The outer peripheral edge portions of the respective fitting holes 18 and the outer peripheral edge portions on the left end surfaces of the welding projections 60 are welded (not illustrated) from the left side surface side of the seat back side frame 16. This secures the ratchet plate 57 to the seat back side frame 16.

Furthermore, the reclining mechanism 25 includes a coupling shaft (not illustrated). The coupling shaft is press-fitted (secured) from the right side of the rear frame 13 to the coupling hole 53 of the cam coupling shaft 52 and extends in the lateral direction. Furthermore, to the right end portion of this coupling shaft, one end portion (a base end portion) of an operating lever 75 (see FIG. 1) is secured.

While the seat back 12 (the seat back side frame 16) is positioned at a first lock position, which is indicated by the solid line in FIG. 1, when the operating lever 75 rotates up to an operating position, the state of the reclining mechanism 25, which is illustrated in FIG. 5, is achieved. Then, the rotary biasing force by a rotary biasing spring, which is disposed in the reclining seat 10, rotates the seat back 12 forward. Then, as illustrated in FIGS. 3 to 5, the ratchet plate 57 rotates in the counterclockwise direction with respect to the base plate 27. Accordingly, with this state, even if releasing the external force given to the operating lever 75, as illustrated in FIG. 5 (FIG. 5 illustrates the state inside the reclining mechanism 25 when the seat back 12 slightly rotates forward from the first lock position), (the outer peripheral surfaces of) the respective engaging projections 40*a* positioned on the inner peripheral side with respect to the unlock retaining surface 57*b* of the respective topping projections 57*a* are in contact with the end portion on the counterclockwise direction side of the unlock retaining surface 57*b* (the one end portion of the unlock retaining surface 57*b* in the extending direction) (see FIG. 5). Thus, the unlock retained state (the state where the reclining mechanism 25 is held in the unlock state or the topping state) is achieved.

The following describes a press molding machine 80 to press-mold the ratchet plate 57 (a final-shaped member) and the base plate 27 (the final-shaped member), which are the components of the reclining mechanism 25, and a press molding method of the ratchet plate 57 and the base plate 27 using the press molding machine 80 mainly with reference to FIGS. 7 to 22.

First, the following describes the basic structure of the press molding machine 80.

Figure 14:
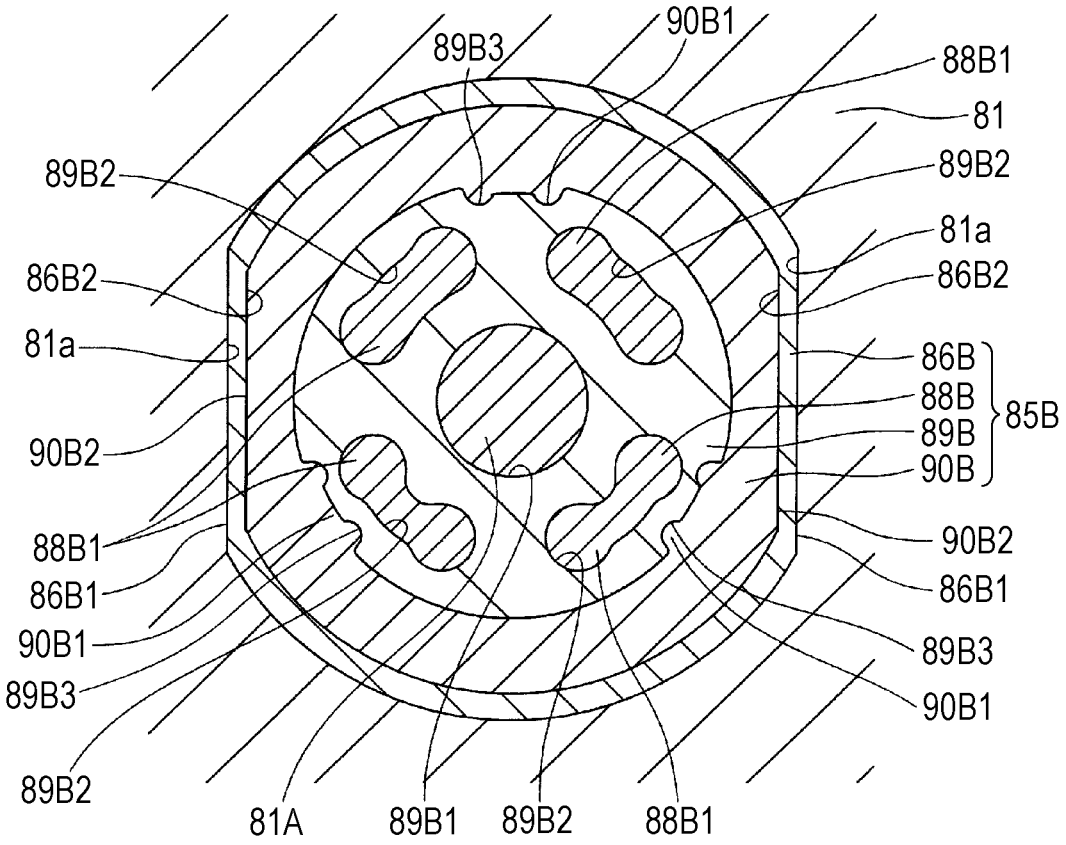
FIG. 14 is a cross-sectional view of a lower mold taken along the arrow line XIV-XIV in FIG. 12.

The press molding machine 80 includes a metallic lower securing member 81 and a center securing member 81A. The lower securing member 81, which has an approximately cylindrical shape, has an axis line extending in the vertical direction. The center securing member 81A has an axis identical to the lower securing member 81 and is securely disposed at the part lower than the lower securing member 81. The cross-sectional shape of the inner peripheral surface on the upper portion of the lower securing member 81 is a circular shape. Meanwhile, the cross-sectional shape of the inner peripheral surface on the lower portion of the lower securing member 81 is a non-circular shape. That is, as illustrated in FIG. 14, the rotation regulating planes 81*a* (rotation regulating portions) are disposed at the inner peripheral surface on the lower portion of the lower securing member 81. The rotation regulating planes 81*a* are perpendicular to the horizontal direction and are formed of two planes parallel to each other. Further, at the lower portion of the lower securing member 81, a discharge slope configuration hole 81*b*, which has the circular shape in cross-section, is formed (see FIGS. 7 to 9). The discharge slope configuration hole 81*b* passes through the lower securing member 81 in the thickness direction thereof (the radial direction). Additionally, the discharge slope configuration hole 81*b* heads downward from the center to the outer periphery side of the lower securing member 81. The center securing member 81A is a columnar member having the diameter identical to the outer diameter of the shaft support hole 59.

Figure 7A:
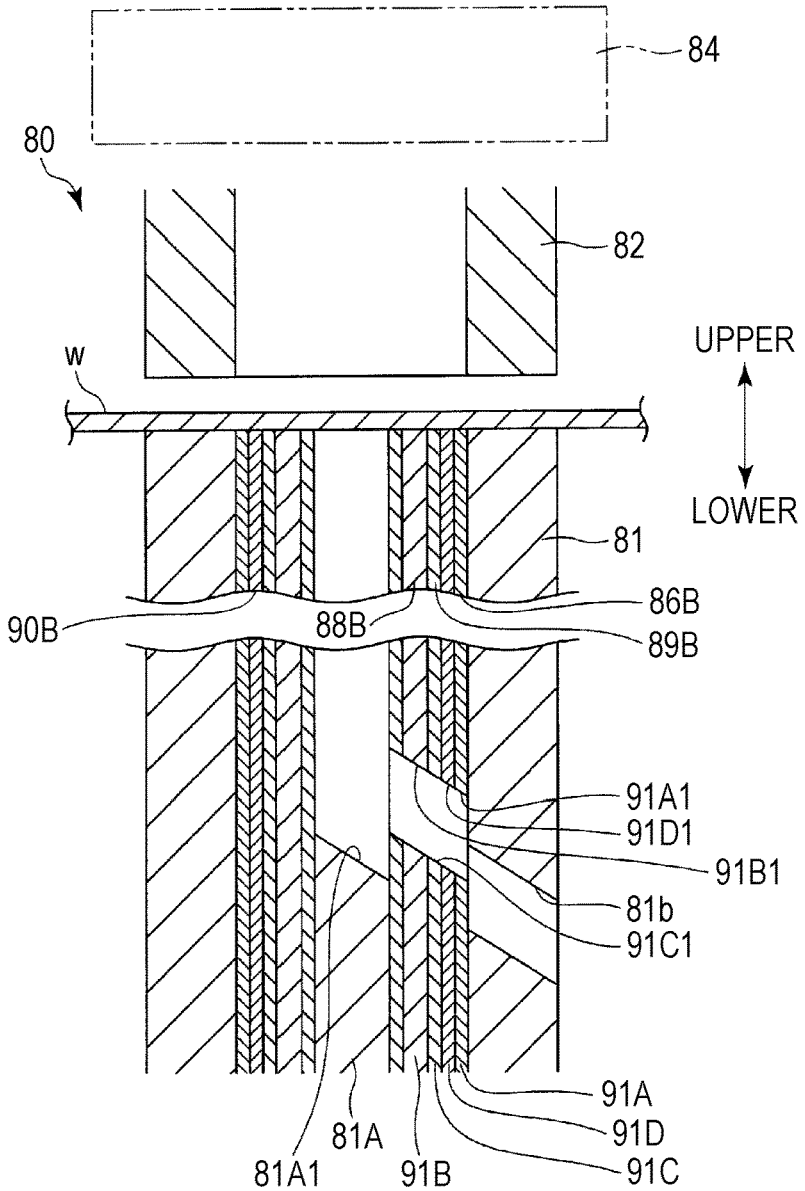
FIG. 7A is a vertical sectional front view of a press molding machine in an initial state to which a molding die for molding a ratchet plate is set.
Figure 7B:
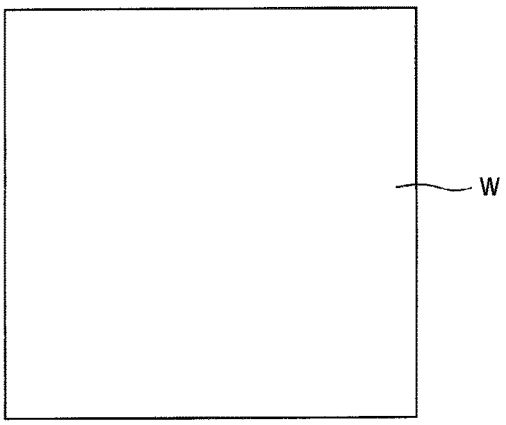
FIG. 7B is a plan view of workpiece at timing identical to FIG. 7A.
Figure 12A:
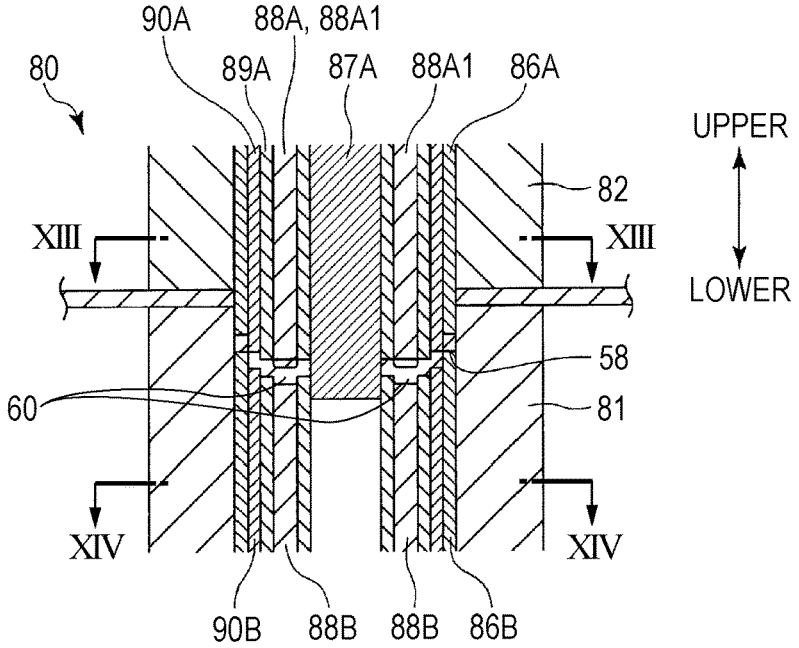
FIGS. 12A to 12C are drawings equivalent to FIG. 10 in a sixth motion during the descending action of the hydraulic cylinder.
Figure 12B:
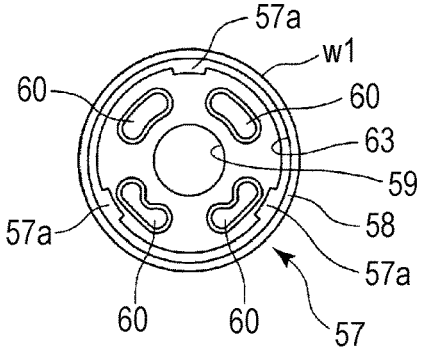
Figure 12C:
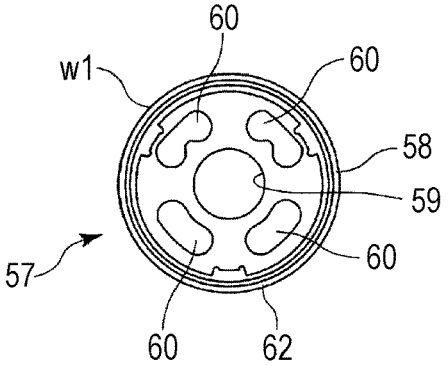
Figure 13:
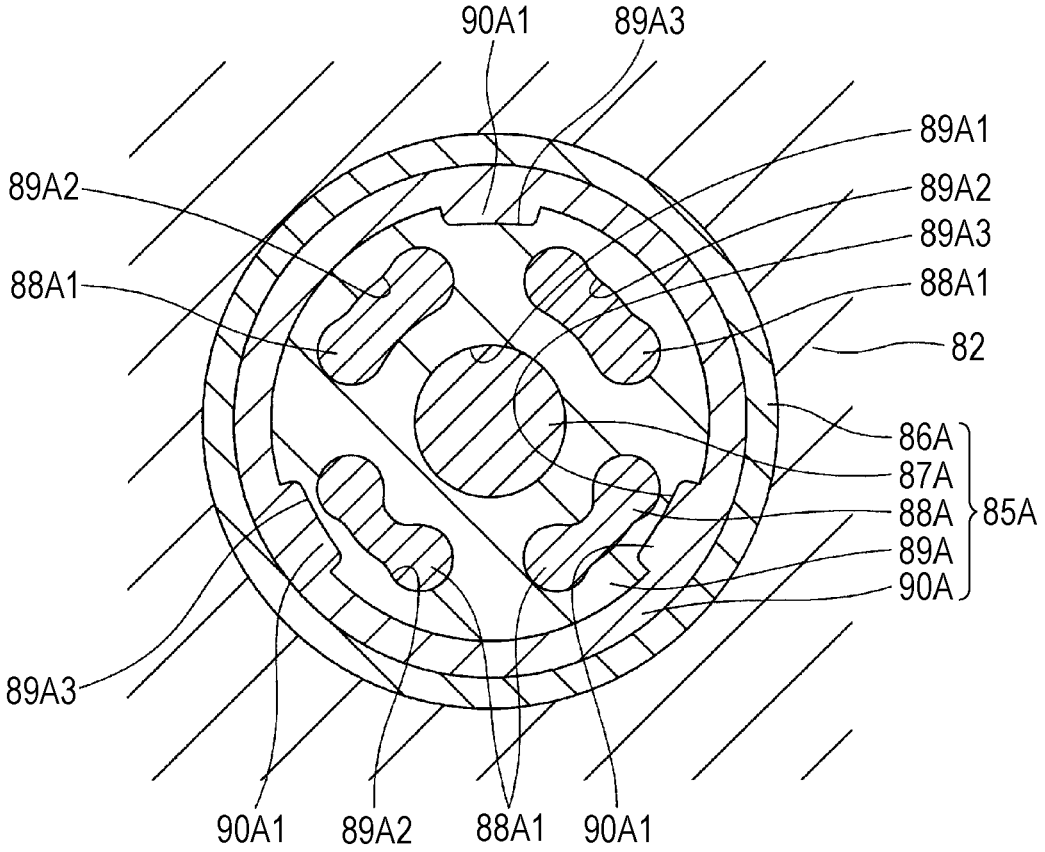
FIG. 13 is a cross-sectional view of an upper mold taken along the arrow line XIII-XIII in FIG. 12.

The press molding machine 80 further includes a metallic slidable sandwiching member 82. The slidable sandwiching member 82 is disposed immediately above the lower securing member 81 so as to have the axis identical to the lower securing member 81. As illustrated in FIG. 13, the cross-sectional shape of the inner peripheral surface on the lower portion of the slidable sandwiching member 82 is a circular shape. The inner peripheral surface on the lower portion of the slidable sandwiching member 82 has identical axis and identical diameter to the inner peripheral surface at the upper portion of the lower securing member 81. Meanwhile, the cross-sectional shape of the inner peripheral surface on the upper portion of the slidable sandwiching member 82 is a non-circular shape. That is, although not illustrated in the drawing, two rotation regulating planes (rotation regulating portions, which are planes similar to the rotation regulating plane 81*a*) are disposed on the inner peripheral surface at the upper portion of the slidable sandwiching member 82. The rotation regulating planes are perpendicular to the horizontal direction and are parallel to one another. The slidable sandwiching member 82 is slidable in the vertical direction. Specifically, the slidable sandwiching member 82 is vertically slidable between the standby position, which is illustrated in FIG. 7, and the sandwich position, which is illustrated in FIGS. 8 to 12.

The press molding machine 80 further includes a hydraulic cylinder 84 (see the imaginary line in FIG. 7) positioned above the slidable sandwiching member 82. This well-known hydraulic cylinder 84 includes a cylinder (not illustrated), a movable rod (not illustrated), and a piston (not illustrated). The cylinder is secured to the main body portion (the securing member) of the press molding machine 80 and vertically extends along the axis line. The movable rod projects from the lower surface of the cylinder to downward and is vertically slidable with respect to the cylinder. The piston is secured to the upper end portion of the movable rod and is slidably in contact with the inner surface of the cylinder with liquid tightly sealed.

Six upper supporting members (not illustrated) are secured to the lower end portion of the movable rod. Six slidable suspension members (not illustrated) are disposed immediately below the lower end portions of the respective upper supporting members. Motor-built-in type upper position adjusting mechanisms couple (the lower portions of) the respective upper supporting members and (the upper portions of) the slidable suspension members. The six upper position adjusting mechanisms finely adjust the vertical position of the corresponding slidable suspension members with respect to the upper supporting members by the power from the built-in motors. The one slidable suspension member secures and supports the slidable sandwiching member 82.

The press molding machine 80 includes four lower supporting members 91A, 91B, 91C, and 91D, which are disposed below the lower securing member 81. These four lower supporting members are vertically slidable. Further, the four lower supporting members 91A, 91B, 91C, and 91D are coupled to respective four motor-built-in type lower position adjusting mechanisms. The four lower position adjusting mechanisms finely adjust the vertical position of the corresponding lower supporting members 91A, 91B, 91C, and 91D by the power from the built-in motors.

Control unit, which is built into the press molding machine 80, controls the operation of the hydraulic cylinder 84 and the operations of the respective motors of the upper position adjusting mechanisms and the lower position adjusting mechanisms.

The following describes the press molding method of the ratchet plate 57 using the press molding machine 80.

When press-molding the ratchet plate 57, an upper mold 85A and a lower mold 85B for a ratchet plate are set to the press molding machine 80.

The upper mold 85A includes five metallic molding dies. That is, the upper mold 85A includes an outer shape cutting molding die 86A, a drilling molding die 87A, a welding projection molding die 88A, a topping projection molding die 89A, and an internal teeth forming molding die 90A. As illustrated in FIG. 13, the outer shape cutting molding die 86A, the drilling molding die 87A, the welding projection molding die 88A, the topping projection molding die 89A, and the internal teeth forming molding die 90A are all assembled so as to be nested having the identical axis. However, the outer shape cutting molding die 86A, the drilling molding die 87A, the welding projection molding die 88A, the topping projection molding die 89A, and the internal teeth forming molding die 90A are independent of one another and are slidable in the vertical direction (the axial direction). Additionally, the outer shape cutting molding die 86A, the drilling molding die 87A, the welding projection molding die 88A, the topping projection molding die 89A, and the internal teeth forming molding die 90A can be attachably/removably set to the lower portions of the five slidable suspension members (the slidable suspension members other than the slidable suspension members that support the slidable sandwiching member 82). Here, the respective outer shape cutting molding die 86A, drilling molding die 87A, welding projection molding die 88A, topping projection molding die 89A, and internal teeth forming molding die 90A are vertically movable in conjunction with the corresponding slidable suspension members.

The outer shape cutting molding die 86A has the axis line extending in the vertical direction and has an approximately cylindrical shape. As illustrated in FIG. 13, the cross-sectional shape of the lower portion of the outer shape cutting molding die 86A is a circular shape. The outer diameter of the outer shape cutting molding die 86A is approximately identical to the outer diameter of the ratchet plate 57. Meanwhile, on the outer peripheral surface on the upper portion of the outer shape cutting molding die 86A, two rotation regulating planes (rotation regulating portions, not illustrated) are disposed. The rotation regulating planes are slidably in contact with the respective two rotation regulating planes of the slidable sandwiching members 82. Additionally, the respective rotation regulating planes are perpendicular to the radial direction of the upper mold 85A. Therefore, the relative rotation of the outer shape cutting molding die 86A around the axis line with respect to the slidable sandwiching member 82 is restricted. Furthermore, two rotation regulating planes (rotation regulating portions, not illustrated) are formed on the inner peripheral surface on the upper portion of the outer shape cutting molding die 86A. The rotation regulating planes are parallel to the respective two rotation regulating planes formed on the outer peripheral surface.

The drilling molding die 87A is a columnar member disposed on the axis line of the center securing member 81A and the outer shape cutting molding die 86A so as to have the axis identical to the center securing member 81A and the outer shape cutting molding die 86A. The outer diameter of the drilling molding die 87A is approximately identical to the outer diameter of the center securing member 81A (the shaft support hole 59).

The welding projection molding dies 88A include four molding parts 88A1. The molding parts 88A1 are disposed on a circumference around the axis line of the outer shape cutting molding die 86A at the equiangular intervals (intervals of 90°). The cross-sectional shapes of the respective molding parts 88A1 are approximately identical to the corresponding welding projections 60.

The topping projection molding die 89A includes a circular hole 89A1 and four non-circular holes 89A2 as through-holes in the vertical direction. The drilling molding die 87A is slidably fitted to the circular hole 89A1. The circular hole 89A1 has the cross-sectional shape identical to the center securing member 81A (the drilling molding die 87A). The four molding parts 88A1 are slidably fitted to the respective non-circular holes 89A2. The non-circular holes 89A2 each have the cross-sectional shape identical to the corresponding molding parts 88A1. This restricts the mutual relative rotation between the topping projection molding die 89A and the welding projection molding die 88A. Furthermore, three topping projection forming cutouts 89A3 are formed on the outer peripheral surface of the topping projection molding die 89A as concave grooves extending in the vertical direction. The three topping projection forming cutouts 89A3 are disposed at the topping projection molding die 89A at equiangular intervals (intervals of 120°) in the outer peripheral direction. The topping projection forming cutout 89A3 has the cross-sectional shape approximately identical to the topping projection 57*a*.

The internal teeth forming molding die 90A has an axis extending in the vertical direction and has an approximately cylindrical shape. As illustrated in FIG. 13, the cross-sectional shape of the internal teeth forming molding die 90A has the approximately circular shape. The outer diameter of the internal teeth forming molding die 90A is approximately identical to the inner diameter of the outer shape cutting molding die 86A. Furthermore, on the outer peripheral surface of the internal teeth forming molding die 90A (for forming the internal teeth 63), unevenness is formed. Meanwhile, on the inner peripheral surface of the internal teeth forming molding die 90A, three convex portions 90A1 are disposed across the vertical direction. The three convex portions 90A1 are disposed at equiangular intervals (intervals of 120°) in the inner peripheral direction of the internal teeth forming molding die 90A. Additionally, the convex portion 90A1 has the cross-sectional shape approximately identical to the topping projection 57*a* and the topping projection forming cutout 89A3. The topping projection forming cutouts 89A3 of the topping projection molding dies 89A are slidably fitted to the respective three convex portions 90A1. This restricts the mutual relative rotation between the topping projection molding die 89A and the internal teeth forming molding die 90A. Furthermore, on the outer peripheral surface on the upper portion of the internal teeth forming molding die 90A, two rotation regulating planes (rotation regulating portions, not illustrated) are disposed. The rotation regulating planes are slidably in contact with the respective two rotation regulating planes formed on the inner peripheral surface on the upper portion of the outer shape cutting molding die 86A. Additionally, the rotation regulating planes are perpendicular to the radial direction of the upper mold 85A. Therefore, the relative rotation of the internal teeth forming molding die 90A around the axis line with respect to the outer shape cutting molding die 86A is restricted. That is, among the molding dies constituting the upper mold 85A, the mutual relative rotation of the outer shape cutting molding die 86A, the welding projection molding die 88A, the topping projection molding die 89A, and the internal teeth forming molding die 90A around the axis line of the upper mold 85A is all restricted.

The lower mold 85B includes four metallic molding dies. That is, the lower mold 85B includes an outer shape cutting molding die 86B, a welding projection molding die 88B, a topping projection molding die 89B, and an internal teeth forming molding die 90B. As illustrated in FIG. 14, the outer shape cutting molding die 86B, the welding projection molding die 88B, the topping projection molding die 89B, and the internal teeth forming molding die 90B are assembled so as to be nested to have the axis identical to one another. However, the outer shape cutting molding die 86B, the welding projection molding die 88B, the topping projection molding die 89B, and the internal teeth forming molding die 90B are independent of one another and are slidable in the vertical direction (the axial direction). The outer shape cutting molding die 86B, the welding projection molding die 88B, the topping projection molding die 89B, and the internal teeth forming molding die 90B can be attachably/removably set to the respective upper portions of the four lower supporting members 91A, 91B, 91C, and 91D (the cross-sectional shapes of the lower portion of the outer shape cutting molding die 86B and the lower supporting member 91A, the lower portion of the welding projection molding die 88B and the lower supporting member 91B, the lower portion of the topping projection molding die 89B and the lower supporting member 91C, and the lower portion of the internal teeth forming molding die 90B and the lower supporting member 91D are approximately identical to one another). At this time, the respective outer shape cutting molding die 86B, welding projection molding die 88B, topping projection molding die 89B, and internal teeth forming molding die 90B and the corresponding lower supporting members 91A, 91B, 91C, and 91D are movable together in the vertical direction.

The outer shape cutting molding die 86B, which has the axis identical to the outer shape cutting molding die 86A, has the axis line extending in the vertical direction and has an approximately cylindrical shape. The cross-sectional shape of the upper portion of the outer shape cutting molding die 86B is a circular shape. The outer diameter of the outer shape cutting molding die 86B is approximately identical to the outer diameter of the ratchet plate 57. Meanwhile, as illustrated in FIG. 14, on the outer peripheral surface on the lower portion of the outer shape cutting molding die 86B, two rotation regulating planes 86B 1 (rotation regulating portions) are disposed. The rotation regulating planes 86B1 are slidably in contact with the respective two rotation regulating planes 81*a* of the lower securing member 81. Additionally, the rotation regulating planes 86B1 are perpendicular to the radial direction of the lower mold 85B. Therefore, the relative rotation of the outer shape cutting molding die 86B around the axis line with respect to the lower securing member 81 is restricted. Furthermore, rotation regulating planes 86B2 (rotation regulating portions) are formed on the inner peripheral surface on the lower portion of the outer shape cutting molding die 86B. The rotation regulating planes 86B2 and the respective rotation regulating planes 86B1 are parallel to one another.

The welding projection molding dies 88B include four molding parts 88B1. The molding parts 88B1 are disposed on the circumference around the axis line of the outer shape cutting molding die 86B (the axis line of the outer shape cutting molding die 86A) at equiangular intervals (intervals of 90°). The cross-sectional shapes of the respective molding parts 88B1 are approximately identical to the corresponding welding projections 60. The molding parts 88B1 are positioned immediately below the respective four molding parts 88A1.

The topping projection molding die 89B includes a circular hole 89B1 and four non-circular holes 89B2 as through-holes in the vertical direction. The drilling molding die 87A is slidably fitted to the circular hole 89B1. The circular hole 89B1 has the cross-sectional shape identical to the drilling molding die 87A. The four molding parts 88B1 are slidably fitted to the respective non-circular holes 89B2. The non-circular holes 89B2 each have the cross-sectional shape identical to the corresponding molding parts 88B1. This restricts the mutual relative rotation between the topping projection molding die 89B and the welding projection molding die 88B. Furthermore, three topping projection forming cutouts 89B3 are formed on the outer peripheral surface of the topping projection molding die 89B as concave grooves extending in the vertical direction. The three topping projection forming cutouts 89B3 are disposed at the topping projection molding die 89B at equiangular intervals (intervals of 120°) in the outer peripheral direction. The topping projection forming cutouts 89B3 are positioned immediately below the respective three topping projection forming cutouts 89A3.

The internal teeth forming molding die 90B, which has the axis identical to the internal teeth forming molding die 90A, has the axis line extending in the vertical direction and has an approximately cylindrical shape. The outer peripheral shape of the upper portion of the internal teeth forming molding die 90B is the cylindrical shape. The outer diameter of the internal teeth forming molding die 90B is approximately identical to the inner diameter of the upper portion of the outer shape cutting molding die 86B. Meanwhile, as illustrated in FIG. 14, on the outer peripheral surface on the lower portion of the internal teeth forming molding die 90B, two rotation regulating planes 90B2 (rotation regulating portions) are disposed. The rotation regulating planes 90B2 are slidably in contact with the respective two rotation regulating planes 86B2. Additionally, the rotation regulating planes 86B2 are perpendicular to the radial direction of the lower mold 85B. This restricts the mutual relative rotation between the internal teeth forming molding die 90B and the outer shape cutting molding die 86B. Furthermore, on the inner peripheral surface of the internal teeth forming molding die 90B, three convex portions 90B1 are disposed across the vertical direction. The three convex portions 90B1 have the cross-sectional shapes identical to the topping projection forming cutouts 89B3. Additionally, the convex portions 90B1 are disposed at the internal teeth forming molding die 90B at equiangular intervals (intervals of 120°) in the inner peripheral direction. The topping projection forming cutouts 89B3 of the topping projection molding die 89B are slidably fitted to the respective three convex portions 90B 1. This restricts the mutual relative rotation between the topping projection molding die 89B and the internal teeth forming molding die 90B. That is, the mutual relative rotation of the outer shape cutting molding die 86B, the welding projection molding die 88B, the topping projection molding die 89B, and the internal teeth forming molding die 90B, which constitute the lower mold 85B, around the axis line of the lower mold 85B is all restricted.

When setting the upper mold 85A and the lower mold 85B to the press molding machine 80, the center axis of the movable members (the upper supporting member, the slidable suspension member, the upper position adjusting mechanism, the lower supporting member, the lower position adjusting mechanism, the slidable sandwiching member 82, the hydraulic cylinder 84, the upper mold 85A, and the lower mold 85B), which contribute to a press descending operation inside the press molding machine 80, extending in the vertical direction matches the center axis (the axis line) of the outer shape cutting molding die 86A with one another. In this embodiment, the center axis of the entire structure formed by adding the lower securing member 81 and the center securing member 81A to these movable members also matches the center axis (the axis line) of the outer shape cutting molding die 86A.

When the press molding machine 80 with the upper mold 85A and the lower mold 85B set is in the initial state, the press molding machine 80 is in the state illustrated in FIG. 7. At this time, the slidable sandwiching member 82 is positioned at the standby position illustrated in FIG. 7. Accordingly, a clearance having a certain amount of size (larger than the wall thickness of workpiece W, which will be described later) is formed between the upper surface of the lower securing member 81 and the lower surface of the slidable sandwiching member 82. The lower ends of the upper mold 85A (the outer shape cutting molding die 86A, the drilling molding die 87A, the welding projection molding die 88A, the topping projection molding die 89A, and the internal teeth forming molding die 90A) are positioned at the upper side more than the lower end of the slidable sandwiching member 82. The top end surfaces (the molding portions) of the outer shape cutting molding die 86B, the welding projection molding die 88B, the topping projection molding die 89B, and the internal teeth forming molding die 90B, which are included in the lower mold 85B, are positioned at the height identical to the top end surface of the lower securing member 81.

With this state, the conveying unit (not illustrated) inserts the workpiece W (the base material), which is formed of a flat-plate shaped metal plate, from the left side in FIG. 7 into the clearance (between the lower securing member 81 and the slidable sandwiching member 82) of the press molding machine 80. Thus, the top end surfaces of the lower securing member 81 and the lower mold 85B support the lower surface of the workpiece W. Then, the actuation of the hydraulic cylinder 84 extends the movable rod downward. Therefore, the slidable sandwiching member 82 and the upper mold 85A, which are supported to the movable rod via the upper supporting member and the slidable suspension member, moves down from the state in FIG. 7. Then, while the movable rod slides from the initial position to a lower end position, which will be described later, the above-described six upper position adjusting mechanisms (the motors) finely adjust the relative positions of the slidable suspension members with respect to the respective upper supporting members in the vertical direction. Therefore, while the movable rod slides from the initial position to the lower end position, the relative positions between the outer shape cutting molding die 86A, the drilling molding die 87A, the welding projection molding die 88A, the topping projection molding die 89A, and the internal teeth forming molding die 90A in the vertical direction change. Simultaneous with this, the upper mold 85A totally moves downward.

Figure 8A:
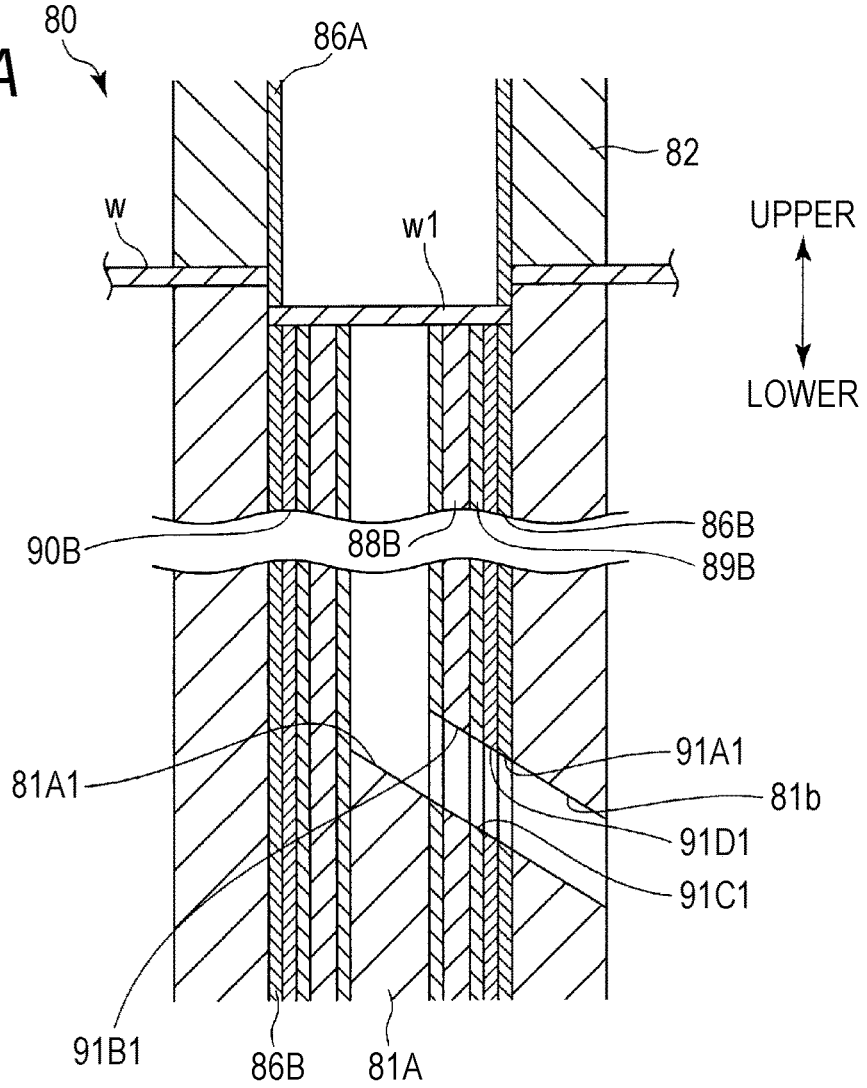
FIGS. 8A and 8B are drawings equivalent to FIG. 7 in first and second motions during a descending action of a hydraulic cylinder.
Figure 8B:
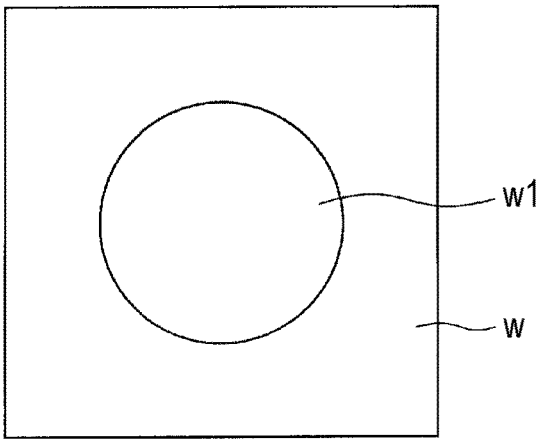

When the movable rod starts moving from the initial position to downward, as illustrated in FIG. 8, the slidable sandwiching member 82 slides up to a sandwich position. Then, the lower securing member 81 and the slidable sandwiching member 82 sandwich the workpiece W from the upper and lower by strong force. Therefore, while the slidable sandwiching member 82 is positioned in the sandwich position, the workpiece W is not able to move on the plane on which the workpiece W is positioned. The operations by the slidable sandwiching member 82 at this time are operations of a first motion in one action (a descending action) of the hydraulic cylinder 84.

The movable rod further moves downward. Then, the upper position adjusting mechanisms (the motors) perform the pressure welding on the molding portion, which is formed on the lower end surface of the outer shape cutting molding die 86A, to the upper surface of the workpiece W while holding the slidable sandwiching member 82 at the sandwich position. Then, when the lower end surface (the molding portion) of the outer shape cutting molding die 86A is in contact with the workpiece W, the lower position adjusting mechanisms move down the all lower supporting members by the amount identical to the outer shape cutting molding die 86A by the power from the motors. Therefore, the entire lower mold 85B moves down by the amount identical to the lower supporting members. That is, the outer shape cutting molding die 86A and the outer shape cutting molding die 86B move downward while maintaining a certain amount of vertical interval between both. Consequently, a disk W1 (an identical outer shape member) along the outer shapes of the molding portion of the outer shape cutting molding die 86A and the molding portion of the outer shape cutting molding die 86B are cut out from the center of the workpiece W to downward.

The operations by the outer shape cutting molding die 86A and the outer shape cutting molding die 86B at this time are operations of a second motion in one action (the descending action) of the hydraulic cylinder 84.

The movable rod of the hydraulic cylinder 84 further moves downward from the state in FIG. 8. Then, the upper position adjusting mechanisms and the lower position adjusting mechanisms perform the pressure welding on the molding portion, which is formed on the lower end surface of the drilling molding die 87A, to the upper surface of the workpiece W while holding the slidable sandwiching member 82, the outer shape cutting molding die 86A, and the outer shape cutting molding die 86B at the positions in FIG. 8. Then, a small-diameter circular plate W2 along the outer shape of the molding portion of the drilling molding die 87A is cut out from the center of the disk W1 to downward. The lower portion of the drilling molding die 87A fits to the circular hole 89A1 (see FIG. 9). The operations by the drilling molding die 87A at this time are operations of a third motion in one action (the descending action) of the hydraulic cylinder 84.

Figure 9A:
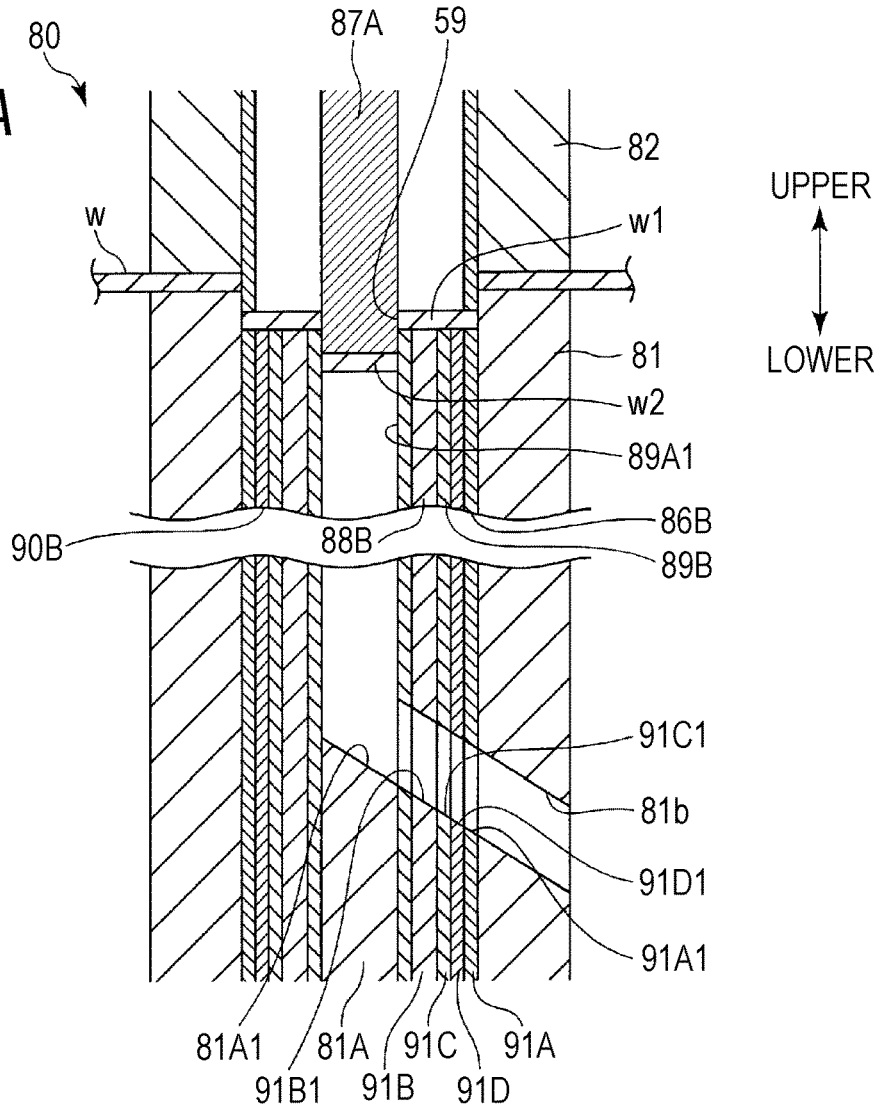
FIGS. 9A and 9B are drawings equivalent to FIG. 7 in a third motion during the descending action of the hydraulic cylinder.
Figure 9B:
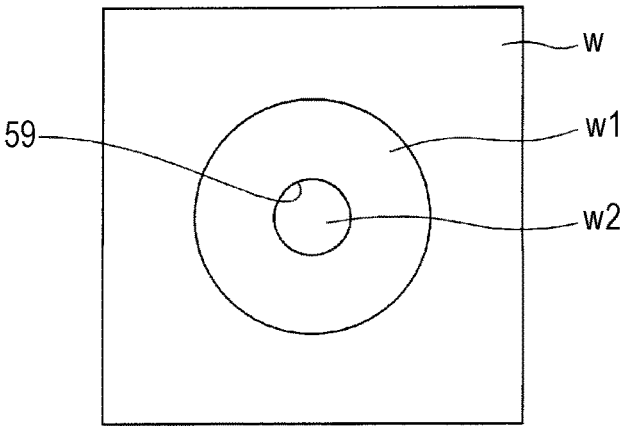

The movable rod of the hydraulic cylinder 84 further moves downward from the state in FIG. 9. Then, the upper position adjusting mechanisms and the lower position adjusting mechanisms perform the pressure welding on the molding portion, which is formed on the lower end surface of the welding projection molding die 88A (the molding parts 88A1), to the upper surface of the disk W1 while holding the slidable sandwiching member 82, the outer shape cutting molding die 86A, the outer shape cutting molding die 86B, and the drilling molding die 87A at the positions in FIG. 9. Then, when the lower end surface (the molding portion) of the welding projection molding die 88A is in contact with the disk W1, the lower position adjusting mechanisms move down the lower supporting members supporting the welding projection molding die 88B by the amount identical to the welding projection molding die 88A by the power from the motors. Therefore, the welding projection molding die 88B moves down by the amount identical to the welding projection molding die 88A. That is, the welding projection molding die 88A and the welding projection molding die 88B move downward while maintaining a certain amount of vertical interval between both. Consequently, the four welding projections 60 along the outer shapes of the molding portion of the welding projection molding die 88A and the molding portion of the welding projection molding die 88B are formed on the disk W1 (see FIG. 10).

The operations by the welding projection molding die 88A and the welding projection molding die 88B at this time are operations of a fourth motion in one action (the descending action) of the hydraulic cylinder 84.

Figure 10A:
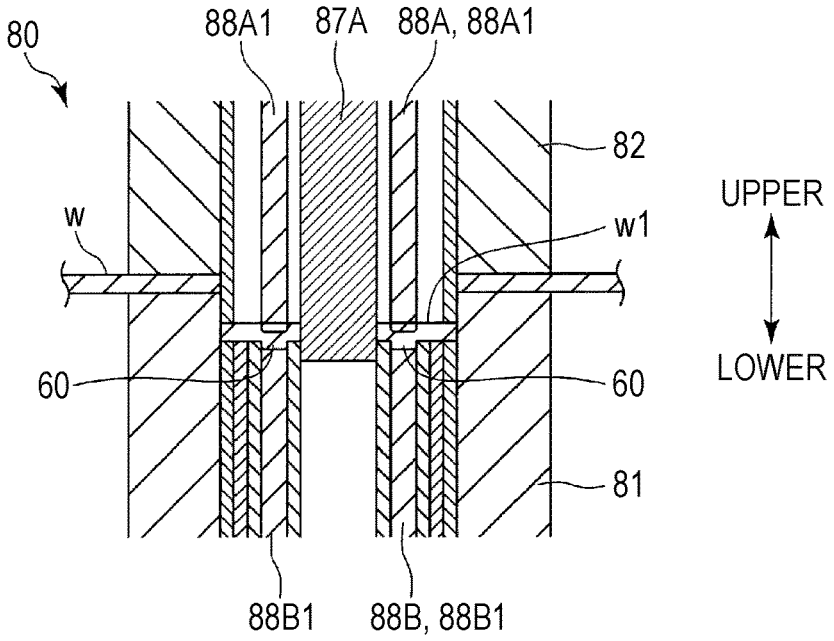
FIGS. 10A and 10B are drawings equivalent to FIG. 7 in a fourth motion during the descending action of the hydraulic cylinder.
Figure 10B:
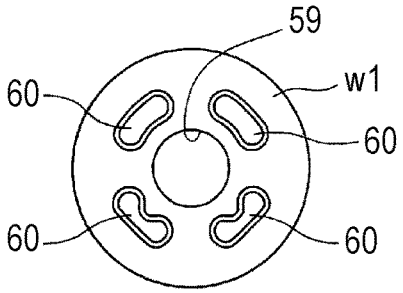
Figure 10C:
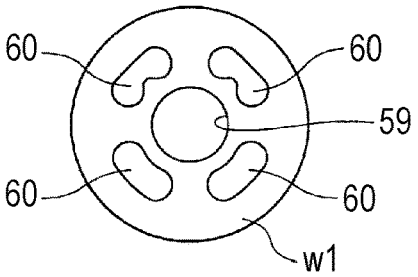
FIG. 10C is a bottom view of the workpiece.

The movable rod of the hydraulic cylinder 84 further moves downward from the state in FIG. 10. Then, the upper position adjusting mechanisms and the lower position adjusting mechanisms perform the pressure welding on the molding portion, which is formed on the lower end surface of the topping projection molding die 89A, to the upper surface of the disk W1 while holding the slidable sandwiching member 82, the outer shape cutting molding die 86A, the outer shape cutting molding die 86B, the drilling molding die 87A, and the welding projection molding die 88A, and the welding projection molding die 88B at the positions in FIG. 10. Then, when the lower end surface (the molding portion) of the topping projection molding die 89A is in contact with the disk W1, the lower position adjusting mechanisms move down the lower supporting members supporting the topping projection molding die 89B and the topping projection molding die 89B by the amount identical to the topping projection molding die 89A by the power from the motors. Furthermore, the upper position adjusting mechanisms and the lower position adjusting mechanisms corresponding to the respective welding projection molding die 88A and the welding projection molding die 88B move down the welding projection molding die 88A and the welding projection molding die 88B by the amount identical to the topping projection molding die 89A by the power from the motors. That is, the topping projection molding die 89A and the topping projection molding die 89B move downward while maintaining a certain amount of vertical interval between both. Additionally, the welding projection molding die 88A and the welding projection molding die 88B move downward by the amount identical to the topping projection molding die 89A and the topping projection molding die 89B while maintaining a certain amount of vertical interval between both (see FIG. 11). Consequently, the parts of the disk W1 sandwiched by the topping projection molding die 89A and the topping projection molding die 89B (and the welding projection 60 and the like) are depressed downward more than the outer peripheral portion of the disk W1 (the part sandwiched by the outer shape cutting molding die 86A and the outer shape cutting molding die 86B) (a level difference occurs between both). Furthermore, the topping projection forming cutout 89A3 of the topping projection molding die 89A forms the three topping projections 57*a*. The operations by the welding projection molding die 88A, the welding projection molding die 88B, the topping projection molding die 89A, and the topping projection molding die 89B at this time are operations of a fifth motion in one action (the descending action) of the hydraulic cylinder 84.

Figure 11A:
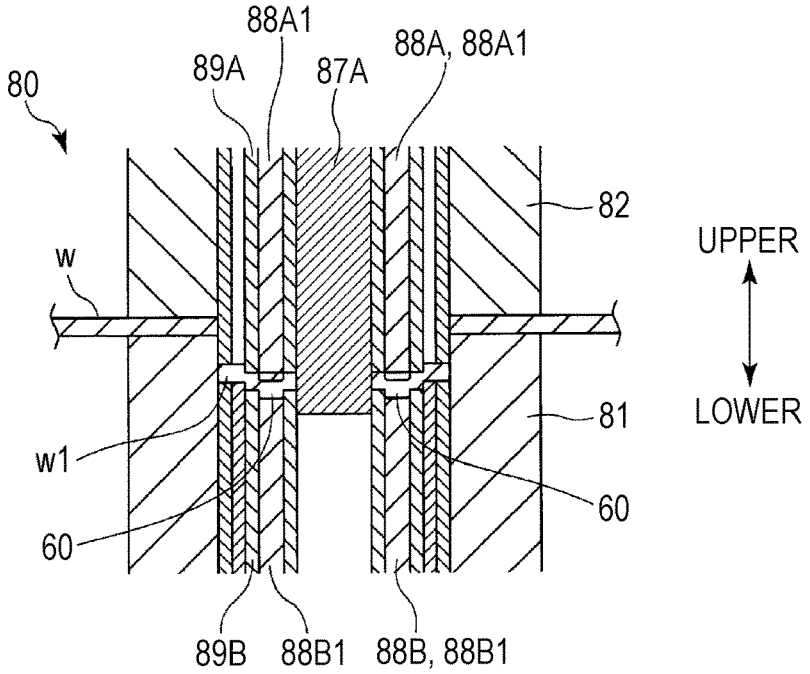
FIGS. 11A to 11C are drawings equivalent to FIG. 10 in a fifth motion during the descending action of the hydraulic cylinder.
Figure 11B:
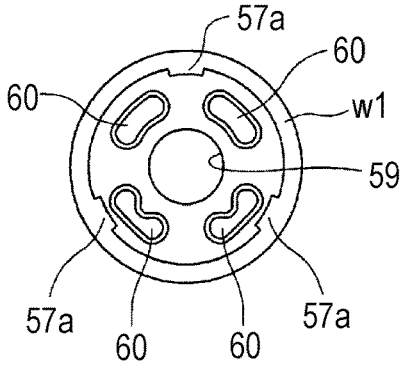
Figure 11C:
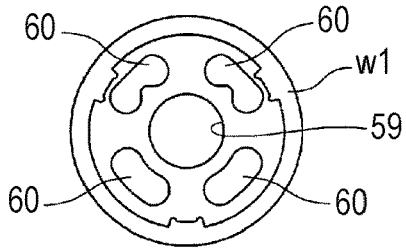

The movable rod of the hydraulic cylinder 84 further moves downward from the state in FIG. 11. Then, the upper position adjusting mechanisms and the lower position adjusting mechanisms perform the pressure welding on the molding portion, which is formed on the lower end surface of the internal teeth forming molding die 90A, to the upper surface of the disk W1 while holding the slidable sandwiching member 82, the outer shape cutting molding die 86A, the outer shape cutting molding die 86B, the drilling molding die 87A, the welding projection molding die 88A, the welding projection molding die 88B, the topping projection molding die 89A, and the topping projection molding die 89B at the positions in FIG. 11. Then, when the lower end surface (the molding portion) of the internal teeth forming molding die 90A is in contact with the disk W1, the lower position adjusting mechanisms move down the lower supporting members supporting the internal teeth forming molding die 90B and the internal teeth forming molding die 90B by the amount identical to the internal teeth forming molding die 90A by the power from the motors. Furthermore, the upper position adjusting mechanisms and the lower position adjusting mechanisms corresponding to the respective welding projection molding die 88A, welding projection molding die 88B, topping projection molding die 89A, and topping projection molding die 89B move down the welding projection molding die 88A, the welding projection molding die 88B, the topping projection molding die 89A, and the topping projection molding die 89B by the amount identical to the internal teeth forming molding die 90A by the power from the motors. That is, the internal teeth forming molding die 90A and the internal teeth forming molding die 90B move downward while maintaining a certain amount of vertical interval between both. Furthermore, the welding projection molding die 88A and the welding projection molding die 88B move downward by the amount identical to the internal teeth forming molding die 90A and the internal teeth forming molding die 90B while maintaining a certain amount of vertical interval between both. Furthermore, the topping projection molding die 89A and the topping projection molding die 89B move downward by the amount identical to the internal teeth forming molding die 90A and the internal teeth forming molding die 90B while maintaining a certain amount of vertical interval between both. Then, when the movable rod moves up to the lower end position, as illustrated in FIG. 12, the parts of the disk W1 sandwiched by the internal teeth forming molding die 90A and the internal teeth forming molding die 90B (and the welding projection 60 and the like) are depressed downward more than the small-diameter annular flange 58, which is the outer peripheral portion of the disk W1 (the part sandwiched by the outer shape cutting molding die 86A and the outer shape cutting molding die 86B), (a level difference occurs between both). Furthermore, the outer peripheral surface of the internal teeth forming molding die 90A forms the internal teeth 63 on the inner peripheral surface of the small-diameter annular flange 58. That is, the ratchet plate 57 for the disk W1 is completed. The operations by the welding projection molding die 88A, the welding projection molding die 88B, the topping projection molding dies 89A and 89B, the internal teeth forming molding die 90A, and the internal teeth forming molding die 90B at this time are operations of a sixth motion in one action (the descending action) of the hydraulic cylinder 84. This last motion (the sixth motion) press-molds the internal teeth 63 on the disk W1. Therefore, the internal teeth 63, which is molded in the sixth motion, retains the shape as it is after that. That is, this allows making the final shape of the internal teeth 63 close to the design shape compared with the case where the internal teeth 63 is press-molded beforehand, and another press molding (for example, the disk W1 is cut out with the outer shape cutting molding die 86A and the outer shape cutting molding die 86B) is performed in the subsequent motion.

After terminating one descending action of the hydraulic cylinder 84 (the sixth motion) by such procedure, the hydraulic cylinder 84 moves to the initial position. Furthermore, the upper position adjusting mechanism and the lower position adjusting mechanism recover the relative positions of the slidable sandwiching member 82, the upper mold 85A, and the lower mold 85B to the initial state (the state in FIG. 7).

Then, the top end surfaces of the welding projection molding dies 88B of the lower mold 85B moved from the position illustrated in FIG. 12 to the initial position (the position in FIG. 7) lift up the respective welding projections 60 of the disk W1 (the ratchet plate 57). This discharges the disk W1 (the ratchet plate 57) upward of the workpiece W (not illustrated).

Then, discharge unit (not illustrated) discharges the workpiece W and the disk W1 (the ratchet plate 57) from the clearance formed between the upper surface of the lower securing member 81 and the lower surface of the slidable sandwiching member 82 to the outside of the press molding machine 80.

The following describes the press molding method for the base plate 27 using the press molding machine 80.

The basic structure of the press molding machine 80 to press-mold the base plate 27 is identical to the press molding machine to press-mold the ratchet plate 57. However, the press molding machine 80 for the base plate 27 differs from the press molding machine 80 for the ratchet plate 57 in the following points. The press molding machine 80 for the base plate 27 includes seven upper supporting members (not illustrated) secured to the lower end portion of the movable rod of the hydraulic cylinder 84. The press molding machine 80 for the base plate 27 includes seven slidable suspension members and seven motor-built-in type upper position adjusting mechanisms. The press molding machine 80 for the base plate 27 includes five lower supporting members (not illustrated) and five motor-built-in type lower position adjusting mechanisms below the lower securing member 81.

To press-mold the base plate 27, an upper mold 92A and a lower mold 92B for base plate are set to the press molding machine 80.

Figure 21:
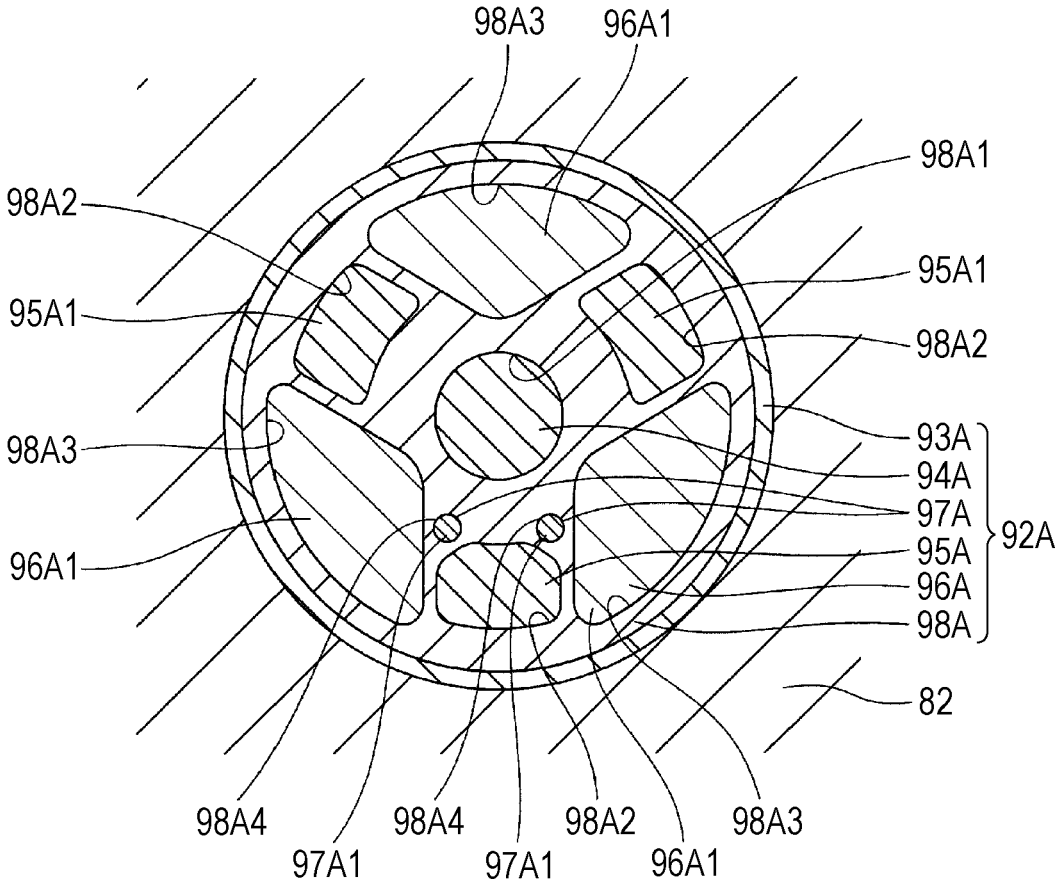
FIG. 21 is a cross-sectional view of an upper mold taken along the arrow line XXI-XXI in FIG. 20.

The upper mold 92A includes six metallic molding dies. That is, the upper mold 92A includes an outer shape cutting molding die 93A, a drilling molding die 94A, a welding projection molding die 95A, a groove forming projection molding die 96A, a locking projection molding die 97A, and a large-diameter flange molding die 98A. As illustrated in FIG. 21, the outer shape cutting molding die 93A, the drilling molding die 94A, the welding projection molding die 95A, the groove forming projection molding die 96A, the locking projection molding die 97A, and the large-diameter flange molding die 98A are assembled so as to be nested to have the axis identical to one another. However, the outer shape cutting molding die 93A, the drilling molding die 94A, the welding projection molding die 95A, the groove forming projection molding die 96A, the locking projection molding die 97A, and the large-diameter flange molding die 98A are independent of one another and are slidable in the vertical direction (the axial direction). Then, the outer shape cutting molding die 93A, the drilling molding die 94A, the welding projection molding die 95A, the groove forming projection molding die 96A, the locking projection molding die 97A, and the large-diameter flange molding die 98A can be attachably/removably set to the lower portions of the six slidable suspension members (the slidable suspension members other than the slidable suspension members that support the slidable sandwiching member 82). With this configuration, the respective outer shape cutting molding die 93A, drilling molding die 94A, welding projection molding die 95A, groove forming projection molding die 96A, locking projection molding die 97A, and large-diameter flange molding die 98A are vertically movable in conjunction with the corresponding slidable suspension members.

The outer shape cutting molding die 93A has the axis line extending in the vertical direction and has an approximately cylindrical shape. As illustrated in FIG. 21, the cross-sectional shape of the lower portion of the outer shape cutting molding die 93A is a circular shape. The outer diameter of the outer shape cutting molding die 93A is approximately identical to the outer diameter of the base plate 27. Meanwhile, on the outer peripheral surface on the upper portion of the outer shape cutting molding die 93A, two rotation regulating planes (rotation regulating portions, not illustrated) are disposed. The rotation regulating planes are slidably in contact with the respective two rotation regulating planes of the slidable sandwiching members 82. Additionally, the respective rotation regulating planes are perpendicular to the radial direction of the upper mold 92A. Therefore, the relative rotation of the outer shape cutting molding die 93A around the axis line with respect to the slidable sandwiching member 82 is restricted. Furthermore, two rotation regulating planes (rotation regulating portions, not illustrated) are formed on the inner peripheral surface on the upper portion of the outer shape cutting molding die 93A. The rotation regulating planes are parallel to the respective two rotation regulating planes formed on the outer peripheral surface.

The drilling molding die 94A is a columnar member disposed above the center securing member 81A (not illustrated in FIGS. 15 to 20). The drilling molding die 94A is disposed at the axis identical to the center securing member 81A and the outer shape cutting molding die 93A. The outer diameter of the drilling molding die 94A is approximately identical to the outer diameter of the center securing member 81A (the shaft support hole 29).

The welding projection molding die 95A includes three molding parts 95A1. The molding parts 95A1 are disposed on the circumference around the axis line of the outer shape cutting molding die 93A at equiangular intervals (intervals of 120°). The cross-sectional shapes of the respective molding parts 95A1 are approximately identical to the corresponding welding projections 33.

The groove forming projection molding die 96A includes three molding parts 96A1. The molding parts 96A1 are disposed on the circumference around the axis line of the outer shape cutting molding die 93A at equiangular intervals (intervals of 120°). The cross-sectional shapes of the respective molding parts 96A1 are approximately identical to the groove forming projection 30.

The locking projection molding die 97A includes two molding parts 97A1. The molding parts 97A1 are disposed on an approximately circumference around the axis line of the outer shape cutting molding die 93A. The cross-sectional shapes of the respective molding parts 97A1 are approximately identical to the locking projection 35.

The large-diameter flange molding die 98A includes a circular hole 98A1, three non-circular holes 98A2, three fan-shaped holes 98A3, and two small-diameter circular holes 98A4 as through-holes in the vertical direction. The drilling molding die 94A slidably fits to the circular hole 98A1. The circular hole 98A1 has the cross-sectional shape identical to the drilling molding die 94A. The three molding parts 95A1 slidably fit to the respective non-circular holes 98A2. The non-circular holes 98A2 each have the cross-sectional shape identical to the corresponding molding parts 95A1. The three molding parts 96A1 slidably fit to the respective fan-shaped holes 98A3. The fan-shaped holes 98A3 each have the cross-sectional shape identical to the corresponding molding parts 96A1. The two molding parts 97A1 slidably fit to the respective small-diameter circular holes 98A4. The small-diameter circular holes 98A4 each have the cross-sectional shape identical to the corresponding molding parts 97A1. This restricts the mutual relative rotation of the welding projection molding die 95A, the groove forming projection molding die 96A, the locking projection molding die 97A, and the large-diameter flange molding die 98A. Furthermore, on the outer peripheral surface on the upper portion of the large-diameter flange molding die 98A, two rotation regulating planes (rotation regulating portions, not illustrated) are disposed. The rotation regulating planes are slidably in contact with the respective two rotation regulating planes formed on the inner peripheral surface on the upper portion of the outer shape cutting molding die 93A. Additionally, the rotation regulating planes are perpendicular to the radial direction of the upper mold 92A. Therefore, the relative rotation of the outer shape cutting molding die 93A and the large-diameter flange molding die 98A around the axis line is restricted. That is, among the molding dies constituting the upper mold 92A, the mutual relative rotation of the outer shape cutting molding die 93A, the welding projection molding die 95A, the groove forming projection molding die 96A, the locking projection molding die 97A, and the large-diameter flange molding die 98A around the axis line of the upper mold 92A is all restricted.

Figure 22:
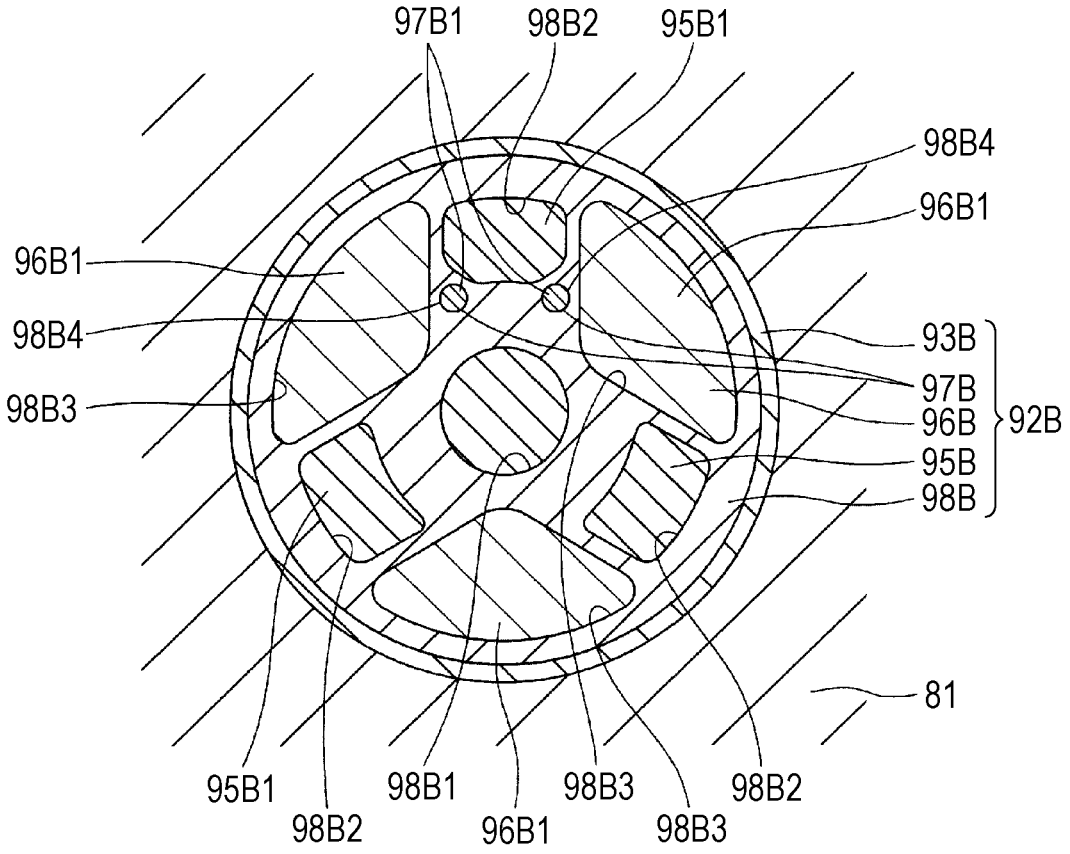
FIG. 22 is a cross-sectional view of a lower mold taken along the arrow line XXII-XXII in FIG. 20.

The lower mold 92B includes five metallic molding dies. That is, the lower mold 92B includes an outer shape cutting molding die 93B, a welding projection molding die 95B, a groove forming projection molding die 96B, a locking projection molding die 97B, and a large-diameter flange molding die 98B. As illustrated in FIG. 22, the outer shape cutting molding die 93B, the welding projection molding die 95B, the groove forming projection molding die 96B, the locking projection molding die 97B, and the large-diameter flange molding die 98B are assembled so as to be nested to have the axis identical to one another. However, the outer shape cutting molding die 93B, the welding projection molding die 95B, the groove forming projection molding die 96B, the locking projection molding die 97B, and the large-diameter flange molding die 98B are independent of one another and are slidable in the vertical direction (the axial direction). Then, the outer shape cutting molding die 93B, the welding projection molding die 95B, the groove forming projection molding die 96B, the locking projection molding die 97B, and the large-diameter flange molding die 98B can be attachably/removably set to the upper portions of the five lower supporting members. Here, the respective outer shape cutting molding die 93B, welding projection molding die 95B, groove forming projection molding die 96B, locking projection molding die 97B, and large-diameter flange molding die 98B are vertically movable in conjunction with the corresponding lower supporting members.

The outer shape cutting molding die 93B, which has the axis identical to the outer shape cutting molding die 93A, has the axis line extending in the vertical direction and has an approximately cylindrical shape. The cross-sectional shape of the upper portion of the outer shape cutting molding die 93B is a circular shape. The outer diameter of the outer shape cutting molding die 93B is approximately identical to the outer diameter of the base plate 27. Meanwhile, on the outer peripheral surface on the lower portion of the outer shape cutting molding die 93B, two rotation regulating planes (rotation regulating portions, not illustrated) are disposed. The rotation regulating planes are slidably in contact with the respective two rotation regulating planes 81*a* of the lower securing member 81. Additionally, the rotation regulating planes are perpendicular to the radial direction of the lower mold 92B. Therefore, the relative rotation of the outer shape cutting molding die 93B around the axis line with respect to the lower securing member 81 is restricted. Furthermore, a pair of rotation regulating planes (not illustrated) is formed on the inner peripheral surface on the lower portion of the outer shape cutting molding die 93B. The rotation regulating planes are parallel to the respective rotation regulating planes formed on the outer peripheral surface. Additionally, the rotation regulating planes are perpendicular to the radial direction of the lower mold 92B.

The welding projection molding die 95B includes three molding parts 95B1. The molding parts 95B1 are disposed on the circumference around the axis line of the outer shape cutting molding die 93B (the axis line of the outer shape cutting molding die 93A) at equiangular intervals (intervals of 120°). The cross-sectional shapes of the respective molding parts 95B1 are approximately identical to the corresponding welding projections 33. The respective molding parts 95B1 are positioned immediately below the corresponding molding parts 95A1.

The groove forming projection molding die 96B includes three molding parts 96B1. The molding parts 96B1 are disposed on the circumference around the axis line of the outer shape cutting molding die 93B at equiangular intervals (intervals of 120°). The cross-sectional shapes of the respective molding parts 96B1 are approximately identical to the groove forming projections 30. The respective molding parts 96B 1 are positioned immediately below the corresponding molding parts 96A1.

The locking projection molding die 97B includes two molding parts 97B1. The molding parts 97B1 are disposed on an approximately circumference around the axis line of the outer shape cutting molding die 93A. The cross-sectional shapes of the molding parts 97B1 are approximately identical to the respective locking projections 35. The respective molding parts 97B1 are positioned immediately below the corresponding molding parts 97A1.

The large-diameter flange molding die 98B, which has an axis identical to the large-diameter flange molding die 98A, includes a circular hole 98B1, three non-circular holes 98B2, three fan-shaped holes 98B3, and two small-diameter circular holes 98B4 as through-holes in the vertical direction. The drilling molding die 94A slidably fits to the circular hole 98B1. The circular hole 98B1 has the cross-sectional shape identical to the drilling molding die 94A. The three molding parts 95B 1 slidably fit to the respective non-circular holes 98B2. The non-circular holes 98B2 each have the cross-sectional shape identical to the corresponding molding parts 95B 1. The three molding parts 96B1 slidably fit to the respective fan-shaped holes 98B3. The fan-shaped holes 98B3 each have the cross-sectional shape identical to the corresponding molding parts 96B 1. The two molding parts 97B 1 slidably fit to the respective small-diameter circular holes 98B4. The small-diameter circular holes 98B4 each have the cross-sectional shape identical to the corresponding molding parts 97B1. This restricts the mutual relative rotation of the welding projection molding die 95B, the groove forming projection molding die 96B, the locking projection molding die 97B, and the large-diameter flange molding die 98B. Furthermore, on the outer peripheral surface on the lower portion of the large-diameter flange molding die 98B, two rotation regulating planes (rotation regulating portions, not illustrated) are disposed. The rotation regulating planes are in contact with the respective two rotation regulating planes formed on the inner peripheral surface on the lower portion of the outer shape cutting molding die 93B. Additionally, the rotation regulating planes are perpendicular to the radial direction of the lower mold 92B. Therefore, the relative rotation of the outer shape cutting molding die 93B and the large-diameter flange molding die 98B is restricted. That is, the mutual relative rotation of the outer shape cutting molding die 93B, the welding projection molding die 95B, the groove forming projection molding die 96B, the locking projection molding die 97B, and the large-diameter flange molding die 98B, which are included in the lower mold 92B, around the axis line of the lower mold 92B is all restricted.

When setting the upper mold 92A and the lower mold 92B to the press molding machine 80, the center axis of the movable members contributing to the press descending operation inside the press molding machine 80 (the upper supporting member, the slidable suspension member, the upper position adjusting mechanism, the lower supporting member, the lower position adjusting mechanism, the slidable sandwiching member 82, the hydraulic cylinder 84, the upper mold 92A, and the lower mold 92B) extending in the vertical direction matches the center axis (the axis line) of the outer shape cutting molding die 93A with one another. In this embodiment, the center axis of the entire structure formed by adding the lower securing member 81 and the center securing member 81A to this movable member also matches the center axis (the axis line) of the outer shape cutting molding die 93A.

Figure 15A:
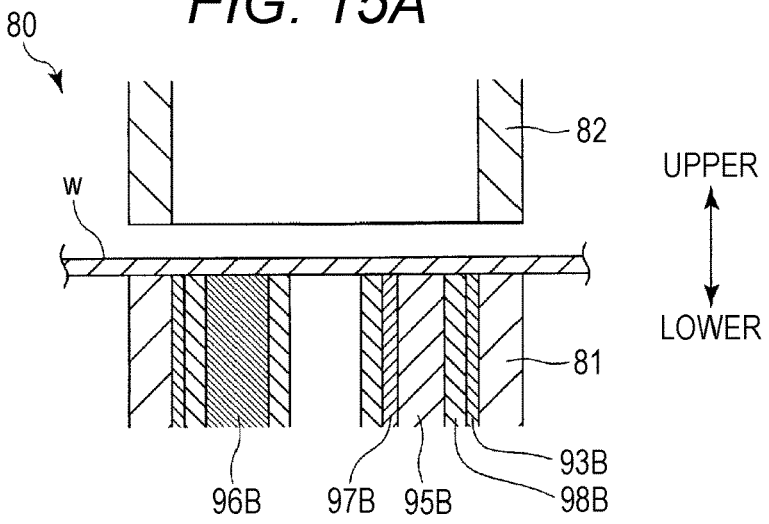
FIG. 15A is a vertical sectional front view of a press molding machine in an initial state to which a molding die for molding a base plate is set.
Figure 15B:
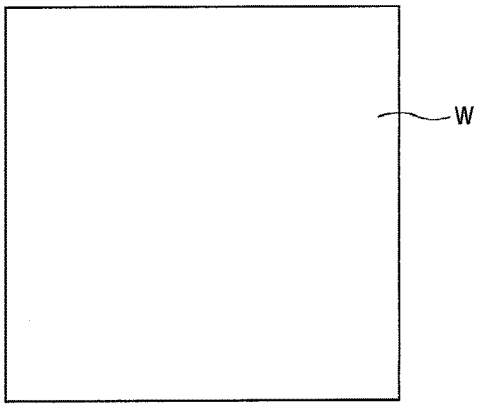
FIG. 15B is a plan view of the workpiece at timing identical to FIG. 15A.
Figure 15C:
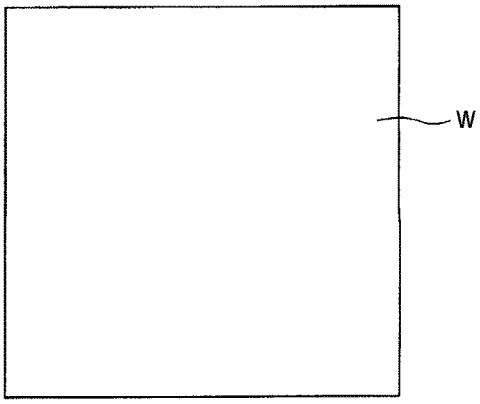
FIG. 15C is a bottom view of the workpiece at timing identical to FIG. 15A.

When the press molding machine 80 with the upper mold 92A and the lower mold 92B set is in the initial state, the press molding machine 80 is in the state illustrated in FIG. 15. That is, as illustrated in FIG. 15, the slidable sandwiching member 82 is positioned in the standby position. The lower end of the upper mold 92A is positioned upward from the lower end of the slidable sandwiching member 82. The top end surfaces (the molding portions) of the outer shape cutting molding die 93B, the welding projection molding die 95B, the groove forming projection molding die 96B, the locking projection molding die 97B, and the large-diameter flange molding die 98B, which constitute the lower mold 92B, are positioned at the height identical to the top end surface of the lower securing member 81.

With this state, the conveying unit (not illustrated) inserts the workpiece W from the left side in FIG. 15 into the clearance (between the lower securing member 81 and the slidable sandwiching member 82) of the press molding machine 80. Thus, the top end surfaces of the lower securing member 81 and the lower mold 92B support the lower surface of the workpiece W. Then, the actuation of the hydraulic cylinder 84 extends the movable rod downward. Therefore, the slidable sandwiching member 82 and the upper mold 92A, which are supported by the movable rod via the upper supporting member and the slidable suspension member, move down from the state in FIG. 15. Then, while the movable rod slides from the initial position to the lower end position, the above-described seven upper position adjusting mechanisms (the motors) finely adjust the relative positions of the respective slidable suspension members with respect to the respective upper supporting members in the vertical direction. Therefore, simultaneous with the change in the vertical relative positions between the outer shape cutting molding die 93A, the drilling molding die 94A, the welding projection molding die 95A, the groove forming projection molding die 96A, the locking projection molding die 97A, and the large-diameter flange molding die 98A, the upper mold 92A totally moves down.

Figure 16A:
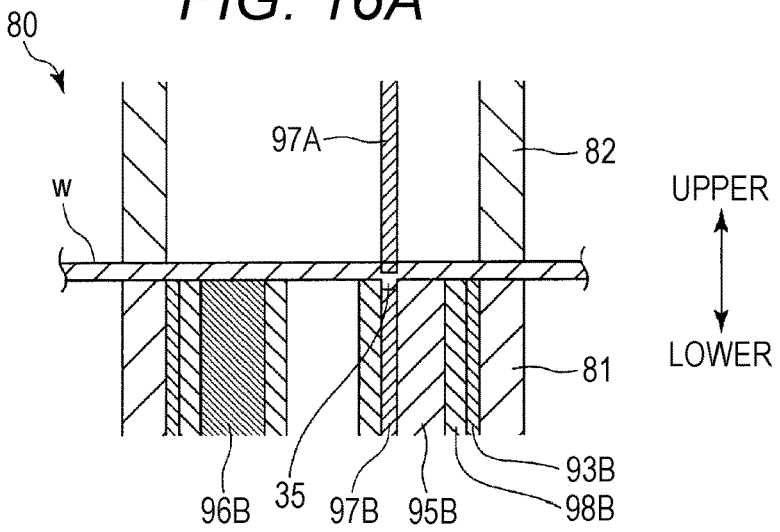
FIGS. 16A to 16C are drawings equivalent to FIG. 15 in the first and second motions during the descending action of the hydraulic cylinder.
Figure 16B:
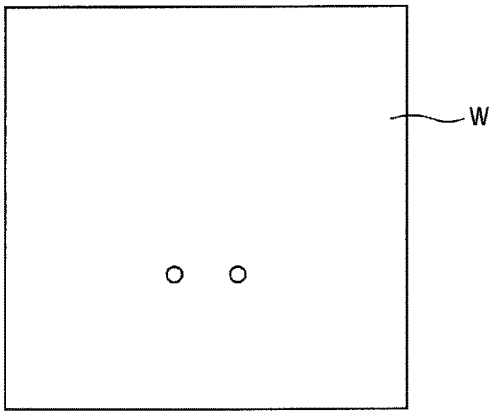
Figure 16C:
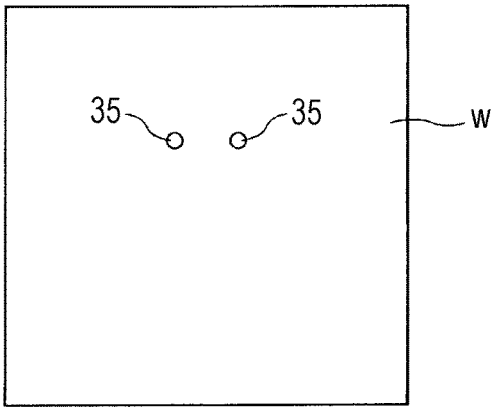

When the movable rod starts moving from the initial position to downward, as illustrated in FIG. 16, the slidable sandwiching member 82 slides up to the sandwich position. Then, the lower securing member 81 and the slidable sandwiching member 82 sandwich the workpiece W from the upper and lower by strong force. The operation by the slidable sandwiching member 82 at this time is an operation of a first motion in one action (the descending action) of the hydraulic cylinder 84.

The movable rod further moves downward. Then, the upper position adjusting mechanisms (the motors) perform the pressure welding on the molding portion, which is formed on the lower end surface of the locking projection molding die 97A, to the upper surface of the workpiece W while holding the slidable sandwiching member 82 at the sandwich position. Then, when the lower end surface (the molding portion) of the locking projection molding die 97A is in contact with the workpiece W, the lower position adjusting mechanisms move down the lower supporting members coupled to the locking projection molding die 97B by the amount identical to the locking projection molding die 97A by the power from the motors. That is, the locking projection molding die 97A and the locking projection molding die 97B move downward while maintaining a certain amount of vertical interval between both. Therefore, the locking projection molding die 97A and the locking projection molding die 97B depress the two sites of the workpiece W downward. Consequently, the locking projections 35 facing downward are formed on these two sites of the workpiece W. The operations by the locking projection molding die 97A and the locking projection molding die 97B at this time are operations of a second motion in one action (the descending action) of the hydraulic cylinder 84.

The movable rod of the hydraulic cylinder 84 further moves downward from the state in FIG. 16. Then, the upper position adjusting mechanisms and the lower position adjusting mechanisms perform the pressure welding on the molding portion, which is formed on the lower end surface of the drilling molding die 94A, to the upper surface of the workpiece W while holding the slidable sandwiching member 82, the locking projection molding die 97A, and the locking projection molding die 97B at the positions in FIG. 16. Therefore, a small-diameter circular plate W4 along the outer shape of the molding portion of the drilling molding die 94A is cut out from the center of the workpiece W to downward (see FIG. 17). The lower portion of the drilling molding die 94A fits to the circular hole 98A1.

The operations by the drilling molding die 94A at this time are operations of a third motion in one action (the descending action) of the hydraulic cylinder 84.

Figure 17A:
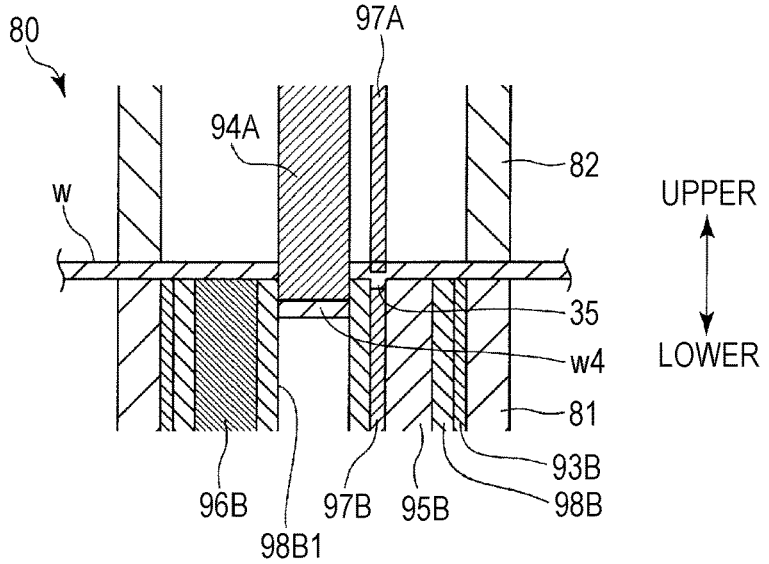
FIGS. 17A to 17C are drawings equivalent to FIG. 15 in the third motion during the descending action of the hydraulic cylinder.
Figure 17B:
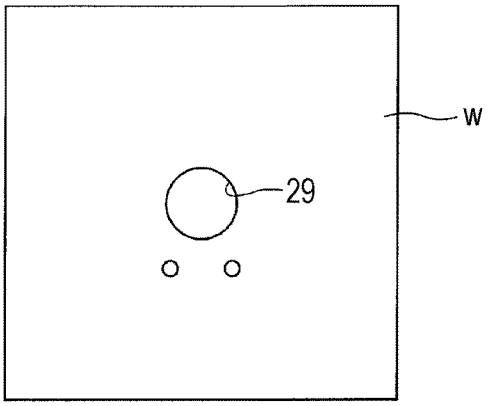
Figure 17C:
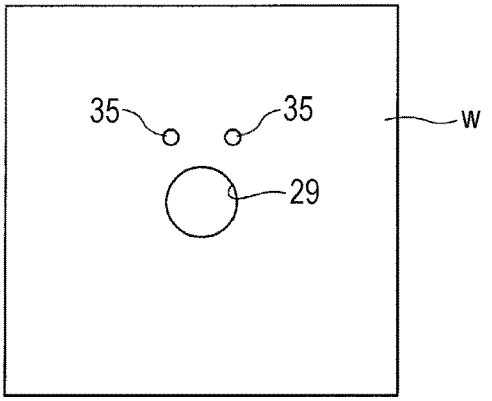
Figure 18A:
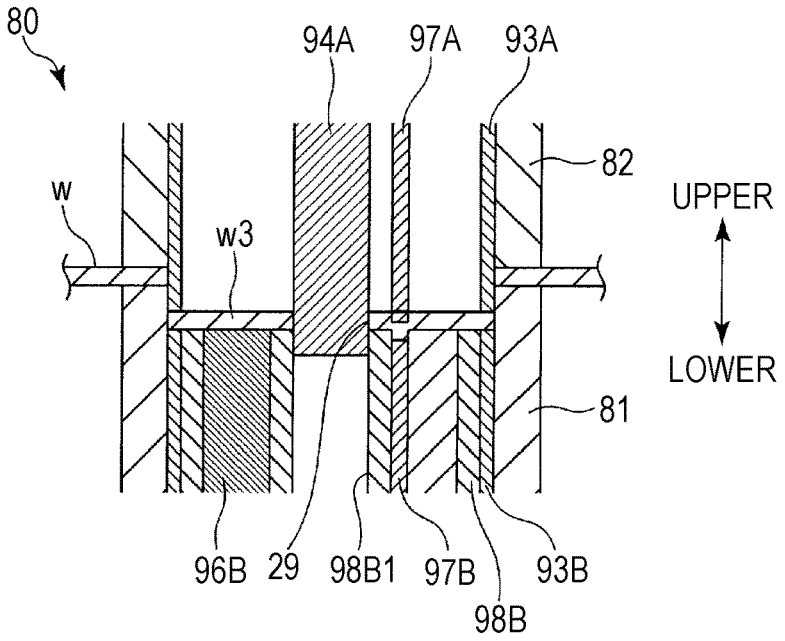
FIGS. 18A to 18C are drawings equivalent to FIG. 15 in the fourth motion during the descending action of the hydraulic cylinder.
Figure 18B:
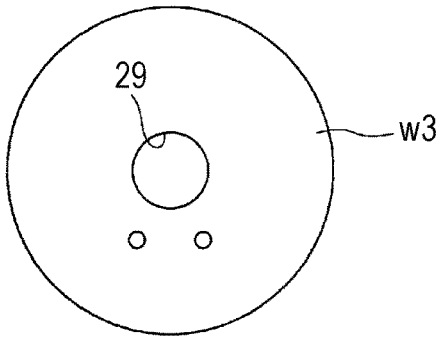
Figure 18C:
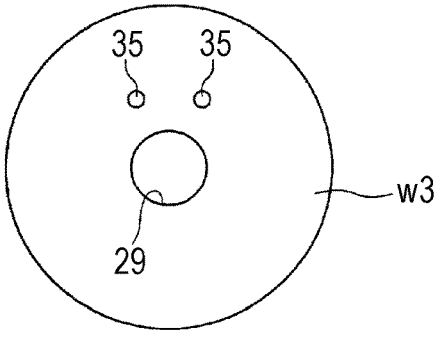

The movable rod of the hydraulic cylinder 84 further moves downward from the state in FIG. 17. Then, the upper position adjusting mechanisms and the lower position adjusting mechanisms perform the pressure welding on the molding portions, which are formed on the lower end surface of the outer shape cutting molding die 93A, to the outer periphery side parts of the shaft support hole 29 and the locking projections 35 on the upper surface of the workpiece W while holding the slidable sandwiching member 82, the locking projection molding die 97A, the locking projection molding die 97B, and the drilling molding die 94A at the positions in FIG. 17. Then, when the lower end surface of the outer shape cutting molding die 93A is in contact with the workpiece W, the lower position adjusting mechanisms move down the all lower supporting members by the amount identical to the outer shape cutting molding die 93A by the power from the motors. Therefore, the entire lower mold 92B moves down by the amount identical to the lower supporting members from the position in FIG. 17. Furthermore, the upper position adjusting mechanisms move down the locking projection molding die 97A by the amount identical to the outer shape cutting molding die 93A. That is, as illustrated in FIG. 18, the outer shape cutting molding die 93A and the outer shape cutting molding die 93B move downward while maintaining a certain amount of vertical interval between both. The locking projection molding die 97A and the locking projection molding die 97B move downward while maintaining a certain amount of vertical interval between both. Consequently, a disk W3 (an identical outer shape member) along the outer shapes of the molding portion of the outer shape cutting molding die 93A and the molding portion of the outer shape cutting molding die 93B are cut out from the center of the workpiece W to downward.

The operations by the outer shape cutting molding die 93A and the lower mold 92B at this time are operations of a fourth motion in one action (the descending action) of the hydraulic cylinder 84.

The movable rod of the hydraulic cylinder 84 further moves downward from the state in FIG. 18. Then, the upper position adjusting mechanisms and the lower position adjusting mechanisms perform the pressure welding on the molding portion, which is formed on the lower end surface of the welding projection molding die 95A (the molding parts 95A1), to the upper surface of the disk W3 while holding the slidable sandwiching member 82, the outer shape cutting molding die 93A, the outer shape cutting molding die 93B, the drilling molding die 94A, the welding projection molding die 95B, the locking projection molding die 97A, the locking projection molding die 97B, the groove forming projection molding die 96B, and the large-diameter flange molding die 98B at the positions in FIG. 18. Then, when the lower end surface (the molding portion) of the welding projection molding die 95A is in contact with the disk W3, the lower position adjusting mechanisms move down the lower supporting members supporting the welding projection molding die 95B (the molding parts 95B1) by the amount identical to the welding projection molding die 95A by the power from the motors. That is, the welding projection molding die 95A and the welding projection molding die 95B move downward while maintaining a certain amount of vertical interval between both (see FIG. 19). Consequently, the three parts of the disk W3 sandwiched by the welding projection molding die 95A and the welding projection molding die 95B are depressed downward more than the disk W3. Consequently, the welding projections 33 and the projection-corresponding concave portions 32 facing downward are formed downward on these three sites. The operations by the welding projection molding die 95A and the welding projection molding die 95B at this time are operations of a fifth motion in one action (the descending action) of the hydraulic cylinder 84.

Figure 19A:
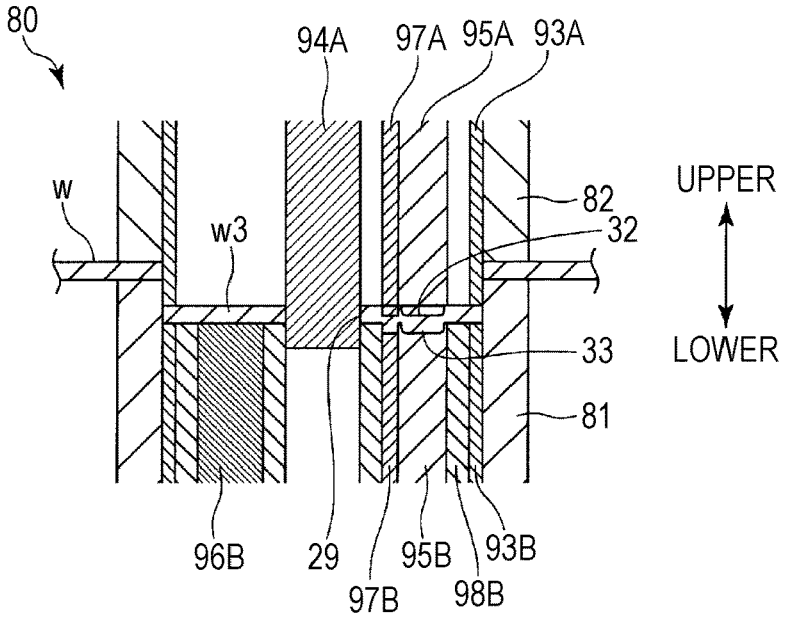
FIGS. 19A to 19C are drawings equivalent to FIG. 15 in the fifth motion during the descending action of the hydraulic cylinder.
Figure 19B:
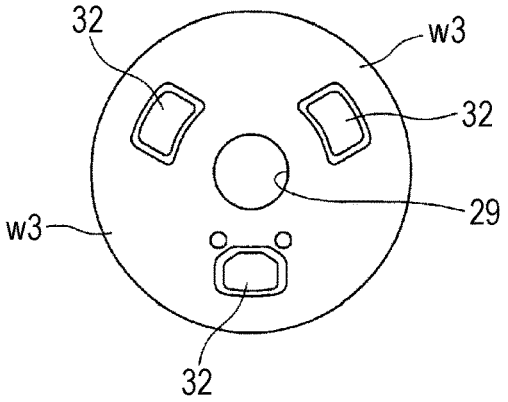
Figure 19C:
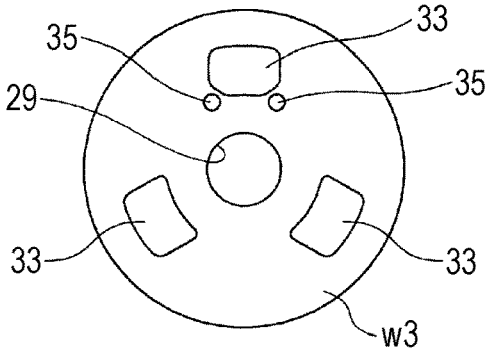
Figure 20A:
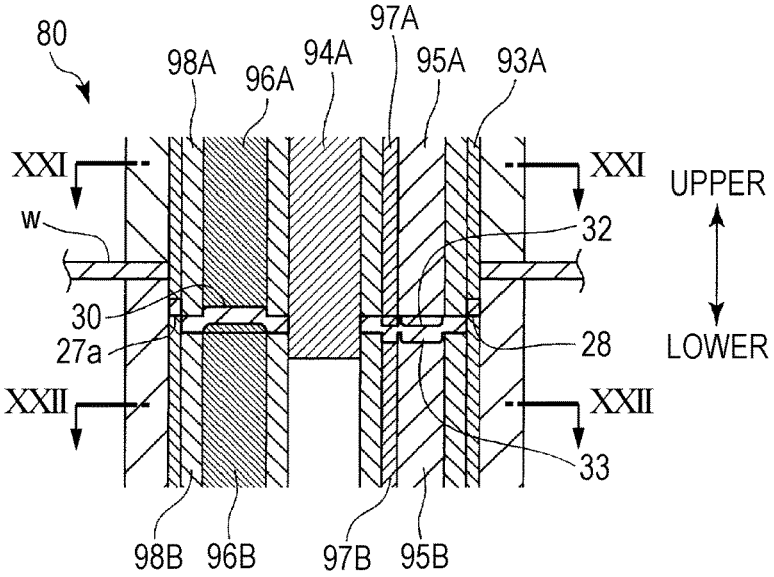
FIGS. 20A to 20C are drawings equivalent to FIG. 15 in the sixth motion during the descending action of the hydraulic cylinder.
Figure 20B:
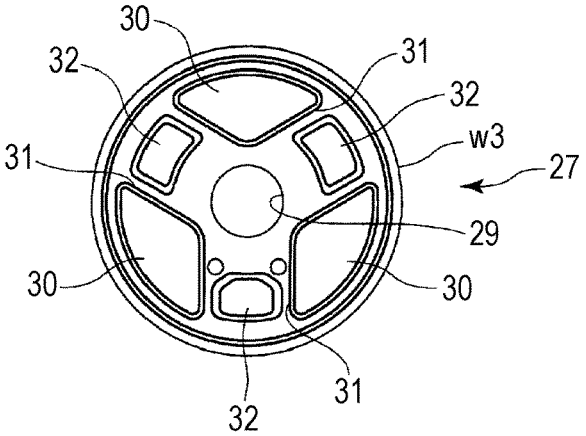
Figure 20C:
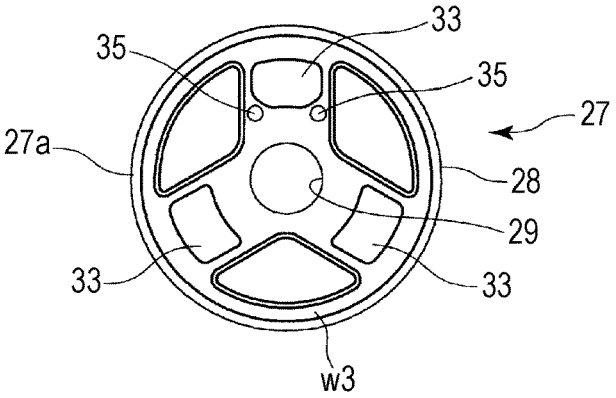

The movable rod of the hydraulic cylinder 84 further moves downward from the state in FIG. 19. Then, the upper position adjusting mechanisms and the lower position adjusting mechanisms perform the pressure welding on the molding portion, which is formed on the lower end surface of the groove forming projection molding die 96A (the molding parts 96A1), to the upper surface of the disk W3 while holding the slidable sandwiching member 82, the outer shape cutting molding die 93A, the outer shape cutting molding die 93B, the drilling molding die 94A, the welding projection molding die 95A, the welding projection molding die 95B, the locking projection molding die 97A, the locking projection molding die 97B, the groove forming projection molding die 96B, and the large-diameter flange molding die 98B at the positions in FIG. 19. Then, the three molding parts 96A1 and the three molding parts 96B1 sandwich the three sites of the disk W3 from the upper and lower (see FIG. 20). Furthermore, when the large-diameter flange molding die 98A is in contact with the upper surface of the disk W3 and the lower end surface (the molding portion) of the large-diameter flange molding die 98A is in contact with the disk W1, the lower position adjusting mechanisms move down the lower supporting members supporting the large-diameter flange molding die 98B by the amount identical to the large-diameter flange molding die 98A by the power from the motors. That is, the large-diameter flange molding die 98A and the large-diameter flange molding die 98B perform the relative movement downward more than the groove forming projection molding die 96A and the groove forming projection molding die 96B while maintaining a certain amount of vertical interval between both. Then, when the movable rod moves up to the lower end position, as illustrated in FIG. 20, the parts of the disk W3 sandwiched by the large-diameter flange molding die 98A and the large-diameter flange molding die 98B are depressed downward more than the large-diameter annular flange 28, which is the outer peripheral portion of the disk W3 (A level difference occurs between both, and as the result, the annular concave portion 27*a* is formed). The guide groove 31 is sandwiched by the large-diameter flange molding die 98A and the large-diameter flange molding die 98B. The guide grooves 31 are concaved at three sites adjacent to the groove forming projection molding die 96A and the groove forming projection molding die 96B. Furthermore, the large-diameter flange molding die 98A (the large-diameter flange molding die 98B) moves downward more than the groove forming projection molding die 96A (more than the groove forming projection molding die 96B). This forms the groove forming projections 30 facing upward at the three parts on the disk W3 (the parts adjacent to the three guide grooves 31) sandwiched by the groove forming projection molding die 96A and the groove forming projection molding die 96B. That is, the disk W3 is completed as the base plate 27. The operations by the groove forming projection molding die 96A, the groove forming projection molding die 96B, the large-diameter flange molding die 98A, and the large-diameter flange molding die 98B at this time are operations of a sixth motion in one action (the descending action) of the hydraulic cylinder 84.

After terminating one descending action of the hydraulic cylinder 84 (the sixth motion) by such procedure, the hydraulic cylinder 84 moves to the initial position. Furthermore, the upper position adjusting mechanism and the lower position adjusting mechanism recover the relative positions of the slidable sandwiching member 82, the upper mold 92A, and the lower mold 92B to the initial state (the state in FIG. 15).

Then, the top end surfaces of the welding projection molding dies 95B moved from the position illustrated in FIG. 20 to the initial position (the position in FIG. 15) lift up the respective welding projections 33 of the disk W3 (the base plate 27). This discharges the disk W3 (the base plate 27) upward of the workpiece W (not illustrated).

As described above, the press molding machine 80 used to the press molding process of the base plate 27 and the ratchet plate 57 of this embodiment includes all the through-holes (the shaft support hole 29 and the shaft support hole 59) and the plurality of inner peripheral molding dies (the drilling molding die 87A, the welding projection molding die 88A, the welding projection molding die 88B, the topping projection molding dies 89A and 89B, the internal teeth forming molding die 90A, the internal teeth forming molding die 90B, the drilling molding die 94A, the welding projection molding die 95A, the welding projection molding die 95B, the groove forming projection molding die 96A, the groove forming projection molding die 96B, the locking projection molding die 97A, the locking projection molding die 97B, the large-diameter flange molding die 98A, and the large-diameter flange molding die 98B). The through-holes are disposed on the disks W1 and W3 on the inner peripheral sides of the outer shape cutting molding dies 86A, 86B, 93A, and 93B, which have the circular shape in cross-section. The outer shape cutting molding dies 86A, 86B, 93A, and 93B cut out the disks W1 and W3 from the workpiece W. The disks W1 and W3 form the outer shapes of the base plate 27 and the ratchet plate 57. The inner peripheral molding dies press-mold the all unevenness (the topping projection 57*a*, the welding projection 60, the internal teeth 63, the groove forming projection 30, the guide groove 31, the welding projection 33, the locking projection 35, and the like). This allows the space to dispose (install) the respective molding dies in the press molding machine 80 to be downsized compared with the progressive press type press molding machine.

Furthermore, all timings of the press moldings with the outer shape cutting molding die and the plurality of inner peripheral molding dies are shifted to one another. This allows mold clamping on the respective molding dies with the hydraulic cylinder 84 (the driving unit) of small output (driving force). This allows using the small-sized hydraulic cylinder 84 (the driving unit). Moreover, the center axis of the movable member, which contributes to the press descending operation in the press molding machine 80, extending in the vertical direction and the center axes (the axis lines) of the outer shape cutting molding dies 86A and 93A mutually match. This does not reduce a load during transmission of the load from the press molding machine 80 (the hydraulic cylinder 84) to the outer shape cutting molding dies 86A and 93A.

This allows downsizing the press molding machine 80 more than the progressive type press molding machine.

Furthermore, the timings of press work with the outer shape cutting molding die and the plurality of inner peripheral molding dies are all shifted to one another. Therefore, to perform the mold clamping on one molding die, the mold clamping force from the other molding dies does not affect the mold clamping force of this molding die.

Accordingly, the mold clamping force from the respective molding dies is easily controlled to a desired magnitude.

The relative rotations among (almost all) the molding dies configuring the upper mold 85A, the lower mold 85B, the upper mold 92A, and the lower mold 92B are restricted. Accordingly, the outer shape cutting molding die and the inner peripheral molding die are less likely to be inclined with respect to the normal mold clamping direction (the vertical direction). This allows the accurate press molding of the base plate 27 and the ratchet plate 57.

The embodiments of this disclosure are described above. However, the press molding method and the press molding machine of this disclosure are not limited to the embodiments. These molding methods and molding machines can be variously modified.

For example, the base plate 27 may be secured to the seat back side frame 16. Similarly, the ratchet plate 57 may be secured to the rear frame 13.

Furthermore, the inner peripheral molding die, which is disposed on the inner peripheral side of the outer shape cutting molding die, may form a through-hole different from the shaft support hole 29 and the shaft support hole 59 on the disk-shaped member (the base plate 27 and the ratchet plate 57). Similarly, the unevenness different from the topping projection 57*a*, the welding projection 60, the internal teeth 63, the groove forming projection 30, the guide groove 31, the welding projection 33, and the locking projection 35 may be formed.

A part of or all of the rotation regulating planes, which are formed at the lower securing member 81, the slidable sandwiching member 82, the upper mold 85A, the lower mold 85B, the upper mold 92A, and the lower mold 92B may be omitted. Alternatively, the rotation regulating planes may be disposed at all the lower securing member 81, the slidable sandwiching member 82, the upper mold 85A, the lower mold 85B, the upper mold 92A, and the lower mold 92B.

Using the press molding machine 80, the upper mold, and the lower mold, the final-shaped member having a configuration different from the base plate 27 and the ratchet plate 57 and the identical outer shape member corresponding to disks W1 and W3 may be press-molded. That is, with the outer shape cutting molding die, the identical outer shape member is press-molded. Additionally, with the plurality of inner peripheral molding dies disposed inside this outer shape cutting molding die, all the through-holes and all the unevenness disposed at the final-shaped member may be press-molded.

In this case, it is not necessary that the outer shapes of the identical outer shape member and the final-shaped member be the circular shape. This outer shape may be the shape other than the circular shape (for example, a triangular shape, a quadrangular shape, and the like). Further, in this case, the cross-sectional shape (the outer shape cutting molding die is cut off along the horizontal surface) of the outer shape cutting molding die is an annular shape corresponding the outer shape of the identical outer shape member.

The press molding method for the disk-shaped member for the reclining mechanism according to the embodiments of this disclosure may be the following first to fifth press molding methods for the disk-shaped member for the reclining mechanism.

The first press molding method for the disk-shaped member for the reclining mechanism may be a method to press-mold the disk-shaped member configured as follows. The disk-shaped member is at least one of members among the base plate and the ratchet plate disposed in the reclining mechanism. The base plate is secured to one of a seat cushion and a seat back while the ratchet plate is secured to the other. The ratchet plate is rotatable relative to this base plate while the ratchet plate is opposed to this base plate. The plurality of inner peripheral molding dies is disposed inside the outer shape cutting molding die. The outer shape cutting molding die has a circular shape in cross-section. The outer shape cutting molding die is configured to press-mold a disk from a base material formed of a metal plate. The disk has an outer shape identical to the disk-shaped member. The inner peripheral molding dies are configured to press-mold all through-holes and all unevenness disposed on the disk-shaped member to the base material or the disk. The press molding method shifts all timings of press moldings to the base material and the disk with the outer shape cutting molding die and the plurality of inner peripheral molding dies to one another.

The second press molding method for the disk-shaped member for the reclining mechanism according to the first press molding method for the disk-shaped member for the reclining mechanism may be configured as follows. The reclining mechanism includes the lock member on the surface of the base plate opposed to the ratchet plate. The lock member is supported so as to be relatively movable in the radial direction of this base plate. The lock member has external teeth on the outer peripheral portion. The ratchet plate has internal teeth on the inner peripheral surface. The internal teeth are engageable with the external teeth of the lock member. The internal teeth are one of the unevenness. Timing of molding of the internal teeth with the inner peripheral molding dies may be later than timing of press molding with the other inner peripheral molding dies and the outer shape cutting molding die. The molding of the internal teeth is configured to mold the internal teeth of the ratchet plate.

The third press molding method for the disk-shaped member for the reclining mechanism according to the first or the second press molding method for the disk-shaped member for the reclining mechanism may be configured as follows. The center axis of a movable member of the press molding machine and a center axis of the outer shape cutting molding die have an axis identical to one another. The press molding machine includes the outer shape cutting molding die and the plurality of inner peripheral molding dies.

The fourth press molding method for the disk-shaped member for the reclining mechanism according to any one of the first to the third press molding methods for the disk-shaped member for the reclining mechanism may be configured as follows. Rotation regulating portions are disposed at opposed portions of the outer shape cutting molding die and the inner peripheral molding dies or/and opposed portions of two of the inner peripheral molding dies adjacent to one another in a radial direction of the outer shape cutting molding die. The inner peripheral molding dies are opposed from an inside of this outer shape cutting molding die. The rotation regulating portions are configured to restrict a relative rotation of opposed molding dies in a circumferential direction.

The fifth press molding method for the disk-shaped member for the reclining mechanism according to the fourth press molding method for the disk-shaped member for the reclining mechanism may be configured as follows. The rotation regulating portions are rotation regulating planes formed of planes formed on the opposed surfaces of respective opposed molding dies.

The press molding method according to the embodiments of this disclosure may be configured as follows. The press molding method disposes a plurality of inner peripheral molding dies inside an outer shape cutting molding die. The outer shape cutting molding die has an annular cross section. The outer shape cutting molding die is configured to press-mold an identical outer shape member from a base material formed of a metal plate. The identical outer shape member has an outer shape identical to a final-shaped member. The inner peripheral molding dies are configured to press-mold all through-holes and all unevenness disposed on the final-shaped member to the base material or the identical outer shape member. All timings of press moldings to the base material and the identical outer shape member with the outer shape cutting molding die and the plurality of inner peripheral molding dies are shifted to one another.

Further, the press molding machine for the disk-shaped member for the reclining mechanism according to the embodiments of this disclosure may be the following first or second press molding machine for the disk-shaped member for the reclining mechanism.

The first press molding machine for the disk-shaped member for the reclining mechanism may be configured as follows. The press molding machine is configured to press-mold the disk-shaped member. The disk-shaped member is at least one of members among the base plate and the ratchet plate disposed in the reclining mechanism. The base plate is secured to one of a seat cushion and a seat back while the ratchet plate is secured to the other. The ratchet plate is rotatable relative to this base plate while the ratchet plate is opposed to this base plate. The press molding machine includes the outer shape cutting molding die and the plurality of inner peripheral molding dies. The outer shape cutting molding die has a circular shape in cross-section. The outer shape cutting molding die is configured to press-mold a disk from a base material formed of a metal plate. The disk has an outer shape identical to the disk-shaped member. The plurality of inner peripheral molding dies is disposed inside this outer shape cutting molding die. The inner peripheral molding dies are configured to press-mold all through-holes and all unevenness disposed on the disk-shaped member to the base material or the disk. The press molding machine shifts all timings of press moldings to the base material and the disk with the outer shape cutting molding die and the plurality of inner peripheral molding dies to one another.

The second press molding machine for the disk-shaped member for the reclining mechanism according to the first press molding machine for the disk-shaped member for the reclining mechanism may be configured as follows. The reclining mechanism includes the lock member on the surface of the base plate opposed to the ratchet plate. The lock member is supported so as to be relatively movable in the radial direction of this base plate. The lock member has external teeth on the outer peripheral portion. The ratchet plate has internal teeth on the inner peripheral surface. The internal teeth are engageable with the external teeth of the lock member. The internal teeth are one of the unevenness. Timing of press molding of the internal teeth with the inner peripheral molding dies may be later than timing of press molding with the other inner peripheral molding dies and the outer shape cutting molding die. The inner peripheral molding dies mold the internal teeth of the ratchet plate.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A press molding method for obtaining a disk-shaped member of a reclining mechanism by press-molding a base material formed of a metal plate, the method comprising:

a first step of supporting a lower surface of a workpiece by a lower securing member and a lower mold, the workpiece being the base material;

a second step of moving down a slidable sandwiching member disposed immediately above the lower securing member so as to have an axis identical to the lower securing member, so that an outer shape cutting molding die is moved down to pressure-weld an end surface of the outer shape cutting molding die to an upper surface of the workpiece while holding the workpiece between the slidable sandwiching member and the lower securing member, and cutting out the workpiece into a disk shape and moving the disk shape downward within a cavity within the lower securing member by moving down the lower mold within the cavity; and a third step of moving down a drilling molding die to pressure-weld an end surface of the drilling molding die to the upper surface of the workpiece cut out into a disk shape while holding the workpiece with the outer shape cutting molding die within the lower securing member, and cutting out a hole in the workpiece by moving down the drilling molding die.

2. The press molding method according to claim 1, further comprising a fourth step of moving down an internal teeth forming molding die to pressure-weld an end surface of the internal teeth forming molding die to the upper surface of the workpiece cut out into a disk shape while holding the workpiece with the outer shape cutting molding die and the drilling molding die within the lower securing member, and forming internal teeth in the workpiece by moving down a first lower molding die, the first lower molding die being included in the lower mold.

3. The press molding method according to claim 2, further comprising:

a fifth step of moving down a welding projection molding die to pressure-weld an end surface of the welding projection molding die to the upper surface of the workpiece cut out into a disk shape while holding the workpiece with the outer shape cutting molding die and the drilling molding die within the lower securing member, and forming a welding projection in the workpiece by moving down a second lower molding die, the second lower molding die being included in the lower mold, wherein the fifth step being performed between the third step and the fourth step.

4. The press molding method according to claim 2, further comprising:

a sixth step of moving down a topping projection molding die to pressure-weld an end surface of the topping projection molding die to the upper surface of the workpiece cut out into a disk shape while holding the workpiece with the outer shape cutting molding die and the drilling molding die within the lower securing member, and forming a topping projection in the workpiece by moving down a third lower molding die, the third lower molding die being included in the lower mold, wherein the sixth step is performed between the third step and the fourth step.

5. The press molding method according to claim 4, further comprising:

a seventh step of moving down a topping projection molding die to pressure-weld an end surface of the topping projection molding die to the upper surface of the workpiece cut out into a disk shape while holding the workpiece with the outer shape cutting molding die, the drilling molding die and the welding projection molding die within the lower securing member, and forming a topping projection in the workpiece by moving down the third lower molding die, wherein the seventh step is performed between the fifth step and the fourth step.

6. A press molding method for obtaining a disk-shaped member of a reclining mechanism by press-molding a base material formed of a metal plate, the method comprising:

a first step of supporting a lower surface of a workpiece by a lower securing member and a lower mold, the workpiece being the base material;

a second step of moving down a slidable sandwiching member disposed immediately above the lower securing member so as to have an axis identical to the lower securing member, so that a drilling molding die is moved down to pressure-weld an end surface of the drilling molding die to an upper surface of the workpiece while holding the workpiece between the slidable sandwiching member and the lower securing member, and cutting out a hole in the workpiece by moving down the drilling molding die; and a third step of moving down an outer shape cutting molding die to pressure-weld an end surface of the outer shape cutting molding die to the upper surface of the workpiece while holding the workpiece with the drilling molding die with the workpiece sandwiched between the slidable sandwiching member and the lower securing member, and cutting out the workpiece into a disk shape and moving the disk shape downward within a cavity within the lower securing member by moving down the lower mold within the cavity.

7. The press molding method according to claim 6, further comprising:

a fourth step of moving down a welding projection molding die to pressure-weld an end surface of the welding projection molding die to the upper surface of the workpiece cut out into a disk shape while holding the workpiece with the outer shape cutting molding die and the drilling molding die within the lower securing member, and forming a welding projection in the workpiece by moving down a lower molding die corresponding to the welding projection forming molding die by an amount identical to the welding projection forming molding die, the lower molding die being included in the lower mold.

* * * * *